US009458621B2

(12) United States Patent
Calafatis et al.

(10) Patent No.: US 9,458,621 B2
(45) Date of Patent: Oct. 4, 2016

(54) TRANSPORTABLE AND EXPANDABLE BUILDING STRUCTURE

(71) Applicant: Expanding Buildings Pty Ltd, Hampton, Victoria (AU)

(72) Inventors: Angelo Calafatis, Hampton (AU); Paul Gorman, Delacombe (AU)

(73) Assignee: Expanding Buildings Pty Ltd, Hampton, Victoria (AU)

( * ) Notice: Subject to any disclaimer, the term of this patent is extended or adjusted under 35 U.S.C. 154(b) by 0 days.

(21) Appl. No.: 14/646,118

(22) PCT Filed: Nov. 28, 2013

(86) PCT No.: PCT/AU2013/001381

§ 371 (c)(1),
(2) Date: May 20, 2015

(87) PCT Pub. No.: WO2014/082129

PCT Pub. Date: Jun. 5, 2014

(65) Prior Publication Data

US 2015/0292194 A1 Oct. 15, 2015

(30) Foreign Application Priority Data

Nov. 28, 2012 (AU) ..... 2012905210

(51) Int. Cl.
*E04B 1/343* (2006.01)
*E04H 1/12* (2006.01)

(52) U.S. Cl.
CPC ..... *E04B 1/34305* (2013.01); *E04B 1/34321* (2013.01); *E04B 1/34336* (2013.01); *E04B 1/34384* (2013.01); *E04B 2001/34389* (2013.01); *E04H 2001/1283* (2013.01)

(58) Field of Classification Search
CPC ..... E04B 1/34305; E04B 1/34384; E04B 1/34336; E04B 1/34321; E04B 2001/34389
See application file for complete search history.

(56) References Cited

U.S. PATENT DOCUMENTS 1,896,433 A * 2/1933 Windeknecht ..... E04B 1/34305 52/67
3,107,116 A 10/1963 Meaker
(Continued)

FOREIGN PATENT DOCUMENTS

AU 2004202437 6/2008
AU WO 2011160167 A1 * 12/2011 ..... B60P 3/025
(Continued)

OTHER PUBLICATIONS

Australian Application No. 2010902775, Australian Search Report mailed on Jul. 13, 2010, 3 pages.
(Continued)

*Primary Examiner* — Rodney Mintz
(74) *Attorney, Agent, or Firm* — Kilpatrick Townsend & Stockton LLP

(57) ABSTRACT

Described embodiments relate to a transportable expandable building structure for human occupancy. The building structure comprises at least first, second and third frame modules arranged to nest with each other in a contracted position and to telescopically expand into an expanded position. One of the first, second and third frame modules is a base unit frame module that forms part of a base unit and the other frame modules are arranged to be movable away from the base unit to adopt the expanded position. The base unit has a fixed floor and is arranged to support the building structure in the contracted position to enable transportation of the building structure by road. Each of the frame modules is different in size from an adjacent one10 of the frame modules and comprises a floor portion, a roof portion and opposed side portions. Each side portion defines a same-sized modular insert region to receive modular door, window or wall inserts.

23 Claims, 30 Drawing Sheets

(56) References Cited

U.S. PATENT DOCUMENTS 3,248,830 A * 5/1966 Maynard ..... E04B 1/34305 52/298
3,304,668 A 2/1967 Edmonds
3,555,748 A * 1/1971 Herman ..... E04B 1/34305 52/121
3,745,725 A * 7/1973 Boucaud ..... E04B 1/34305 254/387
3,845,591 A * 11/1974 Stine ..... E04B 1/34305 135/129
4,271,644 A * 6/1981 Rilliet ..... E04B 1/34305 52/67
4,633,626 A * 1/1987 Freeman ..... E04B 1/34315 52/126.6
4,674,241 A * 6/1987 Sarrazin ..... E04H 3/165 52/67
4,891,919 A 1/1990 Palibroda
4,958,874 A 9/1990 Hegedus
5,156,195 A * 10/1992 Wehler ..... B23Q 11/0825 160/202
5,170,901 A 12/1992 Bersani
5,374,094 A 12/1994 Smith et al.
5,375,902 A 12/1994 Church
5,505,515 A 4/1996 Turner
5,907,928 A 6/1999 Charbonnel
6,283,536 B1 9/2001 Muzyka et al.
6,430,879 B1 8/2002 Nuiry et al.
6,604,327 B1 * 8/2003 Reville ..... E04H 3/165 49/258
6,772,563 B2 * 8/2004 Kuhn ..... E04B 1/3444 220/1.5
7,290,372 B2 * 11/2007 Aust ..... E04B 1/3444 52/66
7,418,802 B2 * 9/2008 Sarine ..... E04B 1/34305 52/79.1
7,784,845 B2 8/2010 Kim et al.
7,930,857 B2 4/2011 Pope
8,381,452 B1 * 2/2013 Forsland ..... E04B 1/0046 4/494
8,695,285 B2 * 4/2014 Reinmann, Jr. ..... E04H 9/16 299/12
8,701,356 B2 * 4/2014 Forsland ..... E04B 1/34305 4/494
8,707,632 B2 * 4/2014 Forsland ..... E04B 1/0046 4/494
2003/0024928 A1 * 2/2003 Serden ..... E04B 1/34305 220/4.04
2003/0029099 A1 * 2/2003 Torata ..... E04B 1/34305 52/67
2003/0115808 A1 6/2003 Morrow
2004/0187397 A1 * 9/2004 Chapus ..... E04H 3/165 52/67
2005/0072062 A1 4/2005 Aust et al.
2005/0160682 A1 * 7/2005 Quadrio ..... B65D 88/005 52/67
2006/0070306 A1 4/2006 Lin
2006/0254160 A1 * 11/2006 Lee ..... E04B 1/34368 52/67
2007/0079573 A1 * 4/2007 Sarine ..... E04B 1/34305 52/592.1
2007/0107321 A1 5/2007 Sarine et al.
2007/0144078 A1 6/2007 Frondelius
2009/0300997 A1 * 12/2009 Scheps ..... E04B 1/34305 52/67
2010/0162636 A1 7/2010 Bonebrake
2010/0320708 A1 * 12/2010 Pope ..... E04B 1/34305 280/30
2011/0308173 A1 * 12/2011 Forsland ..... E04B 1/0046 52/67
2012/0000141 A1 * 1/2012 Forsland ..... E04B 1/34305 52/66
2012/0006369 A1 * 1/2012 Cantin ..... E04B 1/34305 135/96
2012/0090250 A1 * 4/2012 Moscovitch ..... C07C 215/40 52/68
2012/0291363 A1 * 11/2012 Forsland ..... E04B 1/0046 52/67
2013/0042541 A1 * 2/2013 Forsland ..... E04B 1/34305 52/66
2013/0091783 A1 * 4/2013 Reinmann, Jr. ..... E04H 9/16 52/79.5
2013/0305627 A1 * 11/2013 Pike ..... E04B 1/34305 52/79.5
2014/0157684 A1 * 6/2014 Forsland ..... E04B 1/34305 52/66
2014/0360105 A1 * 12/2014 Trout ..... E04B 1/34305 52/79.5
2015/0027067 A1 * 1/2015 Finney ..... E04B 1/34363 52/79.5
2015/0315776 A1 * 11/2015 Duncan ..... A01G 9/14 52/66

FOREIGN PATENT DOCUMENTS

EP 2058456 A1 * 5/2009 ..... E04B 1/34305
ES 2126439 A1 3/1999
JP H06-033518 A 2/1994
WO 92/17667 A1 10/1992
WO 2007104072 9/2007
WO WO 2011088113 A1 * 7/2011 ..... E04B 1/34305
WO 2012/127211 A1 9/2012

OTHER PUBLICATIONS

PCT Application No. PCT/AU2011/000748, International Search Report and Written Opinion mailed on Sep. 11, 2011, 7 pages.
International Search Report and the Written Opinion, International Application No. PCT/AU2013/001381, mailed Feb. 14, 2014.

* cited by examiner

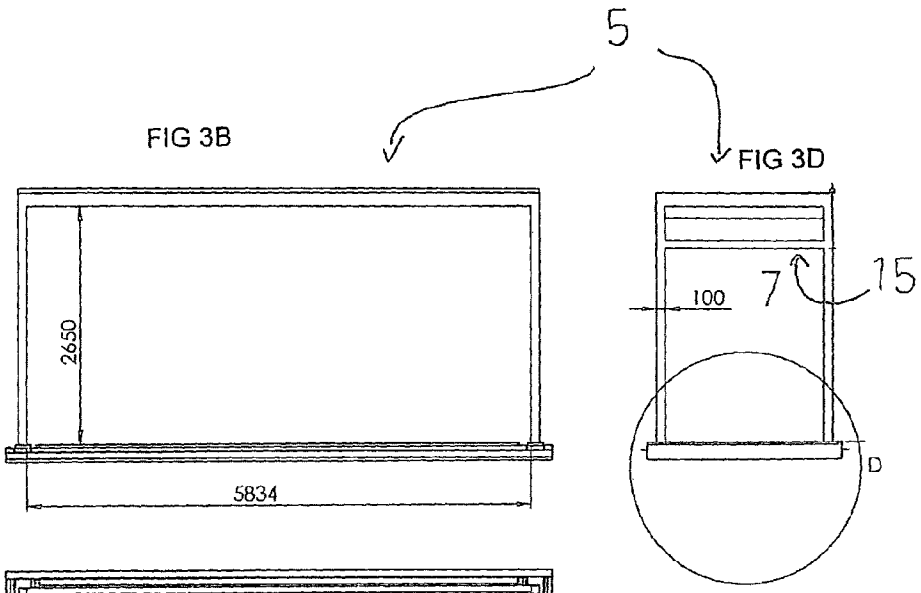
FIG 3D
FIG 3B
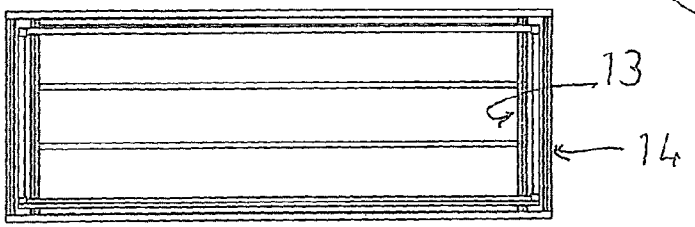
FIG 3C
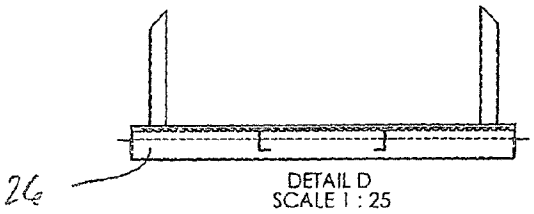
FIG 3E
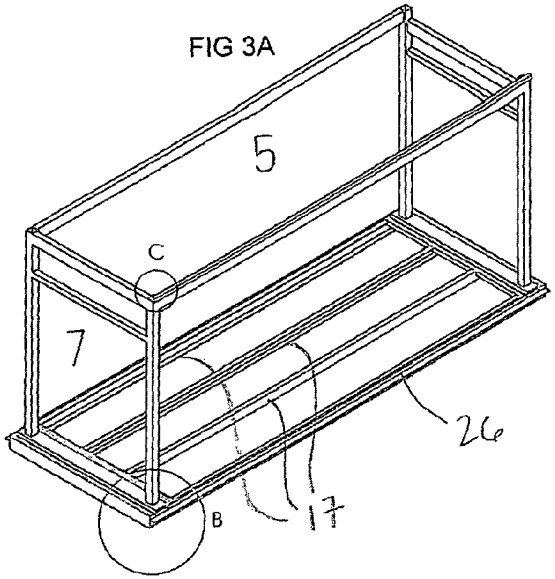
FIG 3A
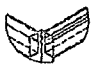
DETAIL C
SCALE 1 : 25
FIG 3G
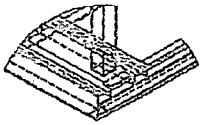
DETAIL B
SCALE 1 : 25
FIG 3F

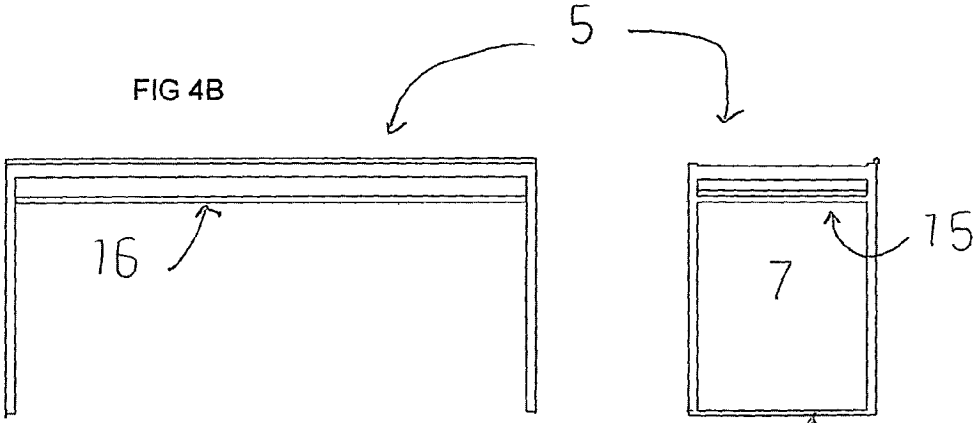
FIG 4B
FIG 4C
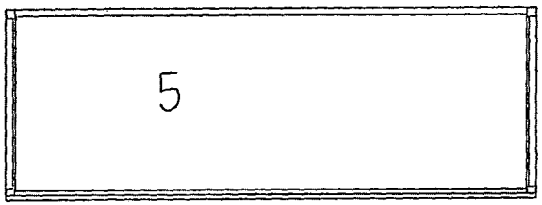
FIG 4D
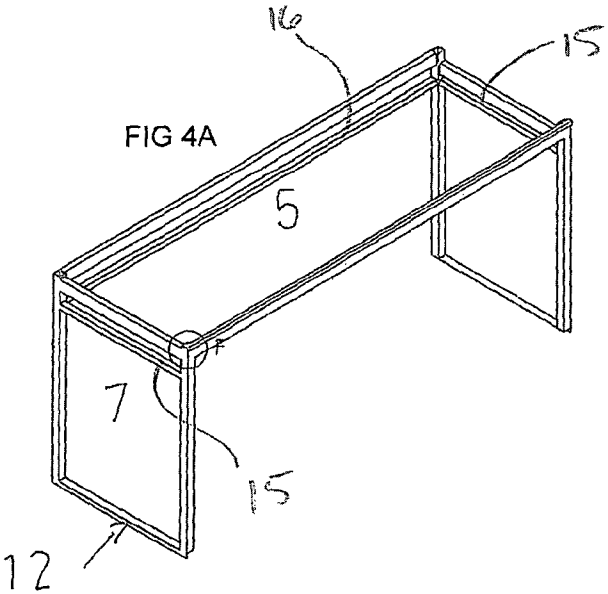
FIG 4A
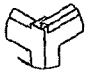
DETAIL F
SCALE 1 : 25
FIG 4E

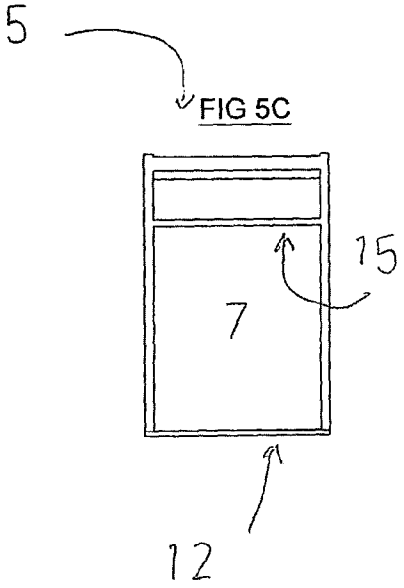
5
FIG 5C
15
7
12
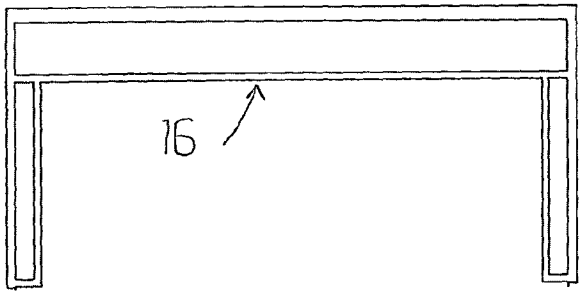
FIG 5B
16
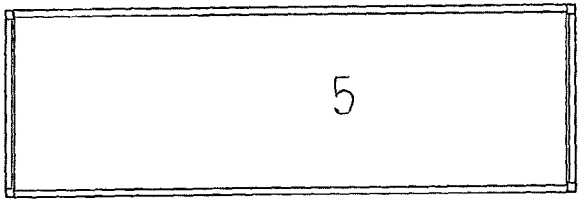
5
FIG 5D
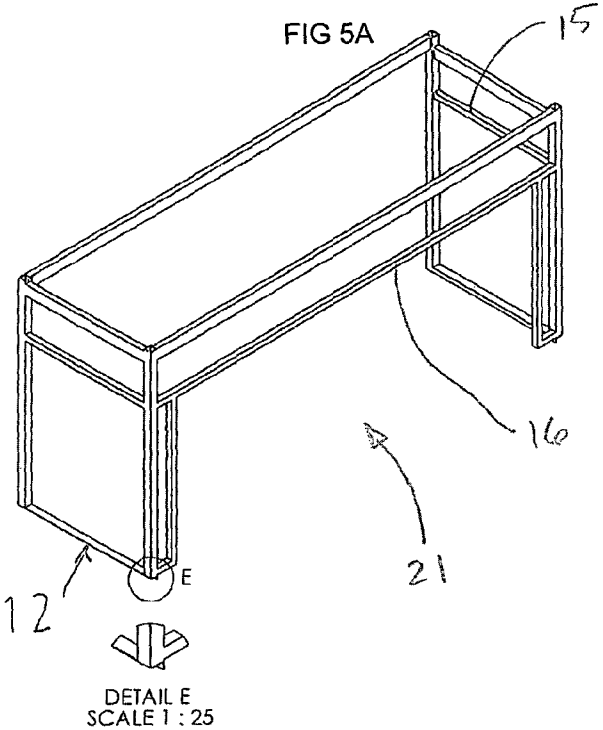
FIG 5A
15
16
21
12
E
DETAIL E
SCALE 1 : 25
FIG 5E

DETAIL H
SCALE 1 : 25

DETAIL G
SCALE 1 : 25

8
9
10
18
G
H

DETAIL L

DETAIL H

DETAIL I

DETAIL G

DETAIL M
81
82

DETAIL N
81
61
1

DETAIL O
61
82
81

DETAIL P
61
81
5
5
5

M
N
P
R
Q
60
61

DETAIL Q
82
66
81
61

DETAIL R
81

2,3,4
1919

1908
2,3,4

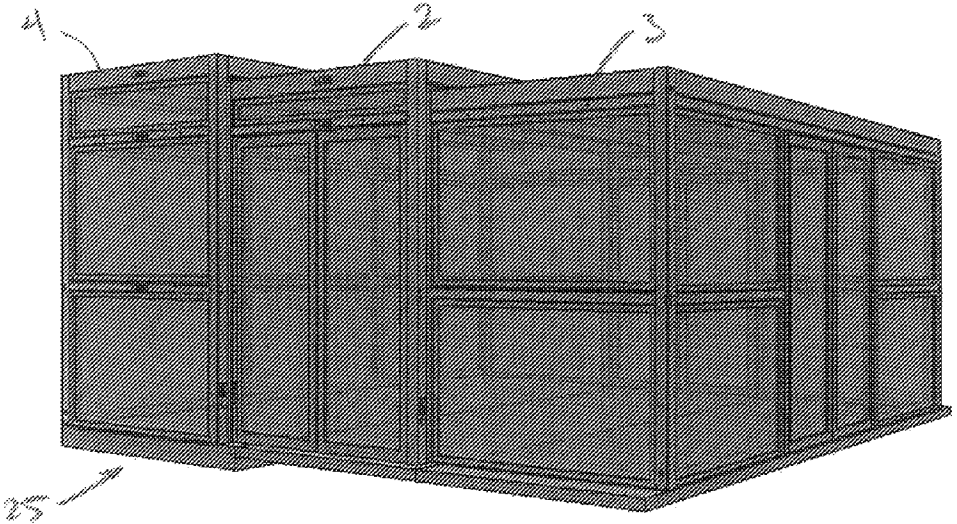
FIG 22A
1900
FIG 22B
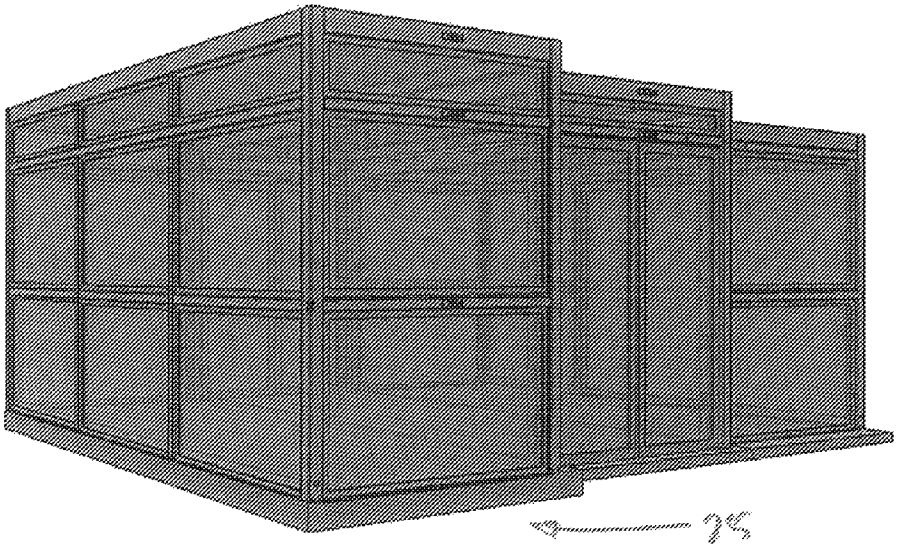

2400

2400

TRANSPORTABLE AND EXPANDABLE BUILDING STRUCTURE

PRIOR RELATED APPLICATIONS

This application is a National Phase application of International Application No. PCT/AU2013/001381, filed Nov. 28, 2013, which claims priority to Australian Patent Application No. 2012905210, filed Nov. 28, 2012, both of which are incorporated herein by reference in their entirety.

TECHNICAL FIELD

Described embodiments generally relate to portable expandable buildings of the like adapted for ready transport to site and rapid and intuitive expansion and erection into a building structure capable of supporting and occupancy by a number of persons in a manner reproducing a room or plurality of rooms offering multiple capacity over the original closed and transportable structure.

BACKGROUND

The demand for the provision of rapid erectable, secure, safe and stable structures capable of accommodating a number of persons is increasing with the increase in prevalence of outdoor venues for entertainment, promotional activities and the like.

Examples of such expanding and transportable buildings include larger structures of the type detailed in International Patent Application PCT/AU2011/000748, the contents of which is incorporated herein by reference.

In addition to such larger structures, a wide range of smaller transportable structures are known in the prior art and range from smaller caravan-type structures to larger unfolding structures that require automation and machine assistance to erect or unfold in order to provide capacity for multiple people.

It is desired to address or ameliorate one or more shortcomings or disadvantages associated with prior expanding habitable structures, or to at least provide a useful alternative thereto.

SUMMARY

Some embodiments relate to a transportable expandable building structure for human occupancy, the building structure comprising:

at least first, second and third frame modules arranged to nest with each other in a contracted position and to telescopically expand into an expanded position;

wherein one of the first, second and third frame modules is a base unit frame module that forms part of a base unit and the other frame modules are arranged to be movable away from the base unit to adopt the expanded position, wherein the base unit has a fixed floor and is arranged to support the building structure in the contracted position to enable transportation of the building structure by road;

wherein each of the frame modules is different in size from an adjacent one of the frame modules and comprises a floor portion, a roof portion and opposed side portions.

Each side portion may define a same-sized modular insert region to receive modular door, window or wall inserts. The first frame module may be an internal frame module, the second frame module may be a central frame module and the third frame module may be an external frame module.

The structure may further comprise a module runner connected to the base unit to guide expansion and contraction of frame modules other than the base unit frame module. The module runner may be hinged to said base unit and moveable between said closed configuration folded against said open end portions of said central module and said open configuration folded down to align with said floor portion of said central module. The module runner may comprise two parallel runner arms hinged at a near end to said central module, with each runner arm including a runner track to guide said internal and said external modules. Side portions of said internal and external modules may include a lower brace incorporating wheels or the like adapted to co-operate with said runner tracks and guide the nesting of said modules.

In the open position, floor parts for the internal module and the external module may be folded down from the central module. The floor parts for the internal module and the external module may each comprise a plurality of floor inserts, each floor insert configured to allow handling by a single operator.

The side portions of each of the central, internal and external modules may comprise side braces positioned to present areas of a same dimension in the side portions of the central, internal and external modules. The end portions of the internal and external modules may comprise end braces positioned to present areas of a same dimension in the internal and external modules. The side portions of each of the central, internal and external modules may comprise connection sections configured to allow a lateral cross-bar to be connected to extend across a respective side portion. The structure may further comprise the lateral cross-bar connected to the connection sections to extend across at least one of the side portions, and may further comprise at least one sub-frame to be supported by the respective at least one side portion and the lateral cross-bar, the at least one sub-frame being configured to receive a modular window or wall insert.

The end portions of each of the internal and external modules may comprise connection sections configured to allow at least one vertical stanchion to be connected to extend across a respective end portion. The structure may further comprise the at least one vertical stanchion connected to end portion connection sections to extend across at least one of the end portions and may further comprise at least one sub-frame to be supported by the respective at least one end portion and at least one vertical stanchion, the at least one sub-frame being configured to receive a modular window, wall or door frame insert.

The at least first, second and third frame modules may comprise drainage structure to drain water from respective roof portions. The structure may further comprise fixation means to fix the first, second and third frame modules in the contracted position or in the expanded position. The fixation means may include a series of apertures located in the first, second and third frame modules so that pins received in aligned ones of the apertures substantially prevent movement of the first, second and third frame modules between the contracted position and the expanded position.

The structure may further comprise a fourth frame module arranged to nest with the first, second and third frame modules. The structure may further comprise a fifth frame module arranged to nest with the first, second, third and fourth frame modules.

Some embodiments relate to an expanded structure for human occupancy comprising a first structure as described herein and a second structure as described herein, wherein the first structure and the second structure are in the expanded position and are positioned adjacent each other and arranged so that internal space of the first structure communicates with internal space of the second structure. The base units of the first and second structures may be arranged in parallel and in lateral alignment. The expanded structure may define a substantially open interior space. The expanded structure may further comprise sealing structure to seal a space between adjacently positioned frame modules of the first and second structures against water ingress. The expanded structure may further comprise a third structure as described herein, wherein the third structure is in the expanded position and is positioned adjacent the first structure, wherein the first structure and the third structure are arranged so that internal space of the first structure communicates with internal space of the third structure.

Some embodiments relate to a transportable, habitable structure adapted for manual erection between a first closed transportable configuration and a second open habitable configuration, said structure comprising a central, generally cuboid module having a floor portion, a roof portion and two side portions; an internal module having a roof portion and two side portions and dimensioned to internally nest with said central module, and an external module having a roof portion and two side portions and dimensioned to externally nest with said central module wherein said structure provides a single level floor throughout the open position.

The structure may include a module runner fitted to either side of said central module to guide said internal and said external modules for said nesting.

The module runner may be hinged to said central module and moveable between said closed configuration folded against said open end portions of said central module and said open configuration folded down to align with said floor portion of said central module.

The module runner may comprise two parallel runner arms hinged at a near end to said central module, optionally joined at the remote ends by a runner brace, with each runner arm including a runner track to guide said internal and said external modules.

The side portions of said internal and external modules may include a lower brace incorporating wheels or the like adapted to co-operate with said runner tracks and guide the nesting of said modules.

BRIEF DESCRIPTION OF THE DRAWINGS

Embodiments are described in further below by way of example and with reference to the Figures.

FIG. 3 shows perspective, plan, front and side elevations of a central module of the structure.

FIG. 4 shows perspective, plan, front and side elevations of an internal module of the structure.

FIG. 5 shows perspective, plan, front and side elevations of an external module of the structure.

FIGS. 22A and 22B are perspective views of the expandable building structure of FIGS. 19A and 19B, showing the structure in an open position, with the centre and internal modules extended away from the external module, which in such embodiments forms part of a base unit of the structure.

DETAILED DESCRIPTION

Figure 1:
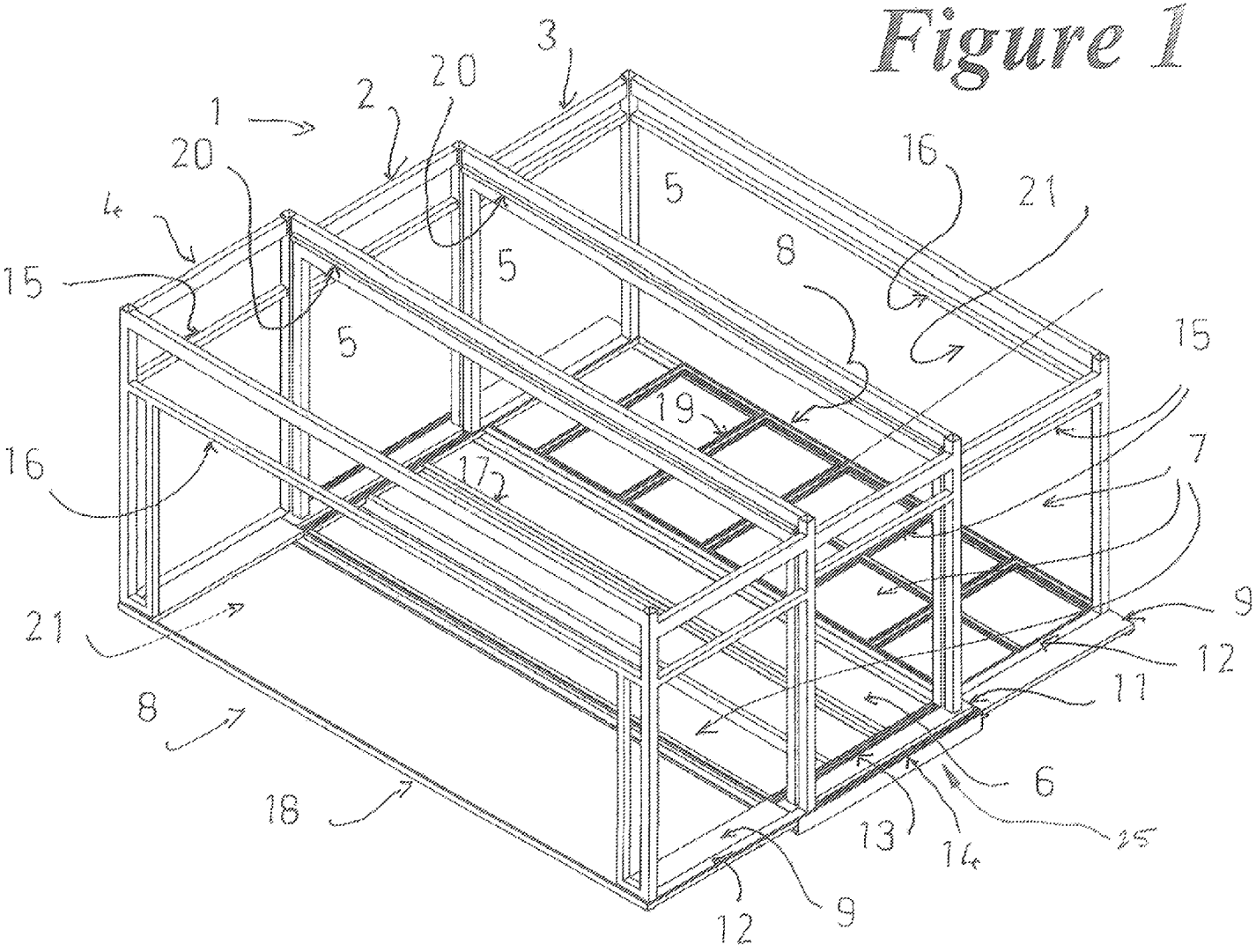
FIG. 1 shows a perspective schematic view of an open structure according to some embodiments.

Referring firstly to FIGS. 1 to 5, an example structure according to some embodiments is shown in perspective view in FIG. 1 in the fully expanded opened position where the structure 1 includes a central module 2 and an internal module 3 adapted for slideable co-operation within the confines of the central module 2 so as to effect a nesting of the central and internal module and an external module 4 also adapted to co-operate with the central module by nesting, by sliding over the outside of the central module 2.

Figures 2A, 2B, 2C:
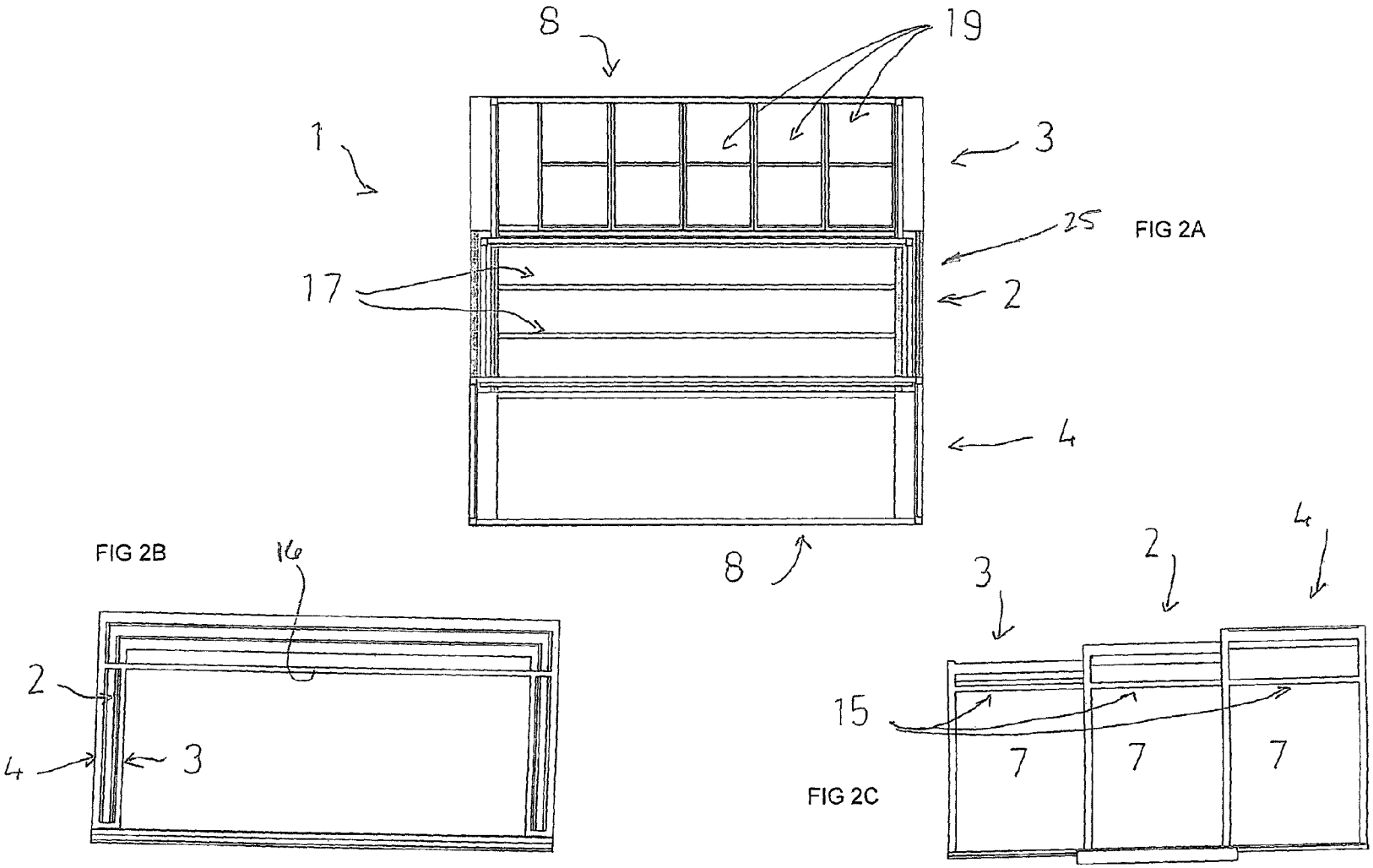
FIG. 2 shows a plan, front and side schematic elevation of the open structure of FIG. 1.

The general configuration and mode of operation of the habitable structure has similarities with an inverted filing cabinet or drawer system with the central internal and external modules acting in the manner of a series of inverted drawers which can move from a fully nested or closed first position and drawn out to a second open configuration in a manner shown in FIG. 1 and FIG. 2.

In order to provide a suitable configuration for habitation or at least temporary occupancy, the central, internal and external modules are formed in a generally cuboid form with the central module having a floor portion 6, a roof portion 5 and two side portions 7. In this manner, the central module 2 forms the heart of the structure with the roof portion 5 adapted to receive suitable roofing materials, side portions 7 adapted to receive suitable windows and other cladding materials and the floor portion 6 including integral floor bearers 17. In this description, the term cuboid is used to indicate shapes having squared sides, as opposed to rounded sides, and does not indicate that the shape of the modules should strictly resemble a cube. Rather, the term cuboid should be understood to specifically include the shapes of the expandable and expanded building structures shown in the drawings and described herein.

Co-operating with the central module 2 is a smaller internal module 3. The internal module 3 has a similar configuration to the central module 2 but does not have an integral floor portion as can be seen from FIG. 4.

Similarly, the external module 4 as shown in FIG. 5 does not have a floor portion and the external module 4 is dimensioned larger than the central module 2 so as to allow the external module 4 to slide over the top of and nest outside the central module 2 whilst the internal module 3 slides within and nests inside the central module 2.

Figures 6A, 6B, 6C, 6D, 6E, 6F, 6G, 6H, 6I, 6J:
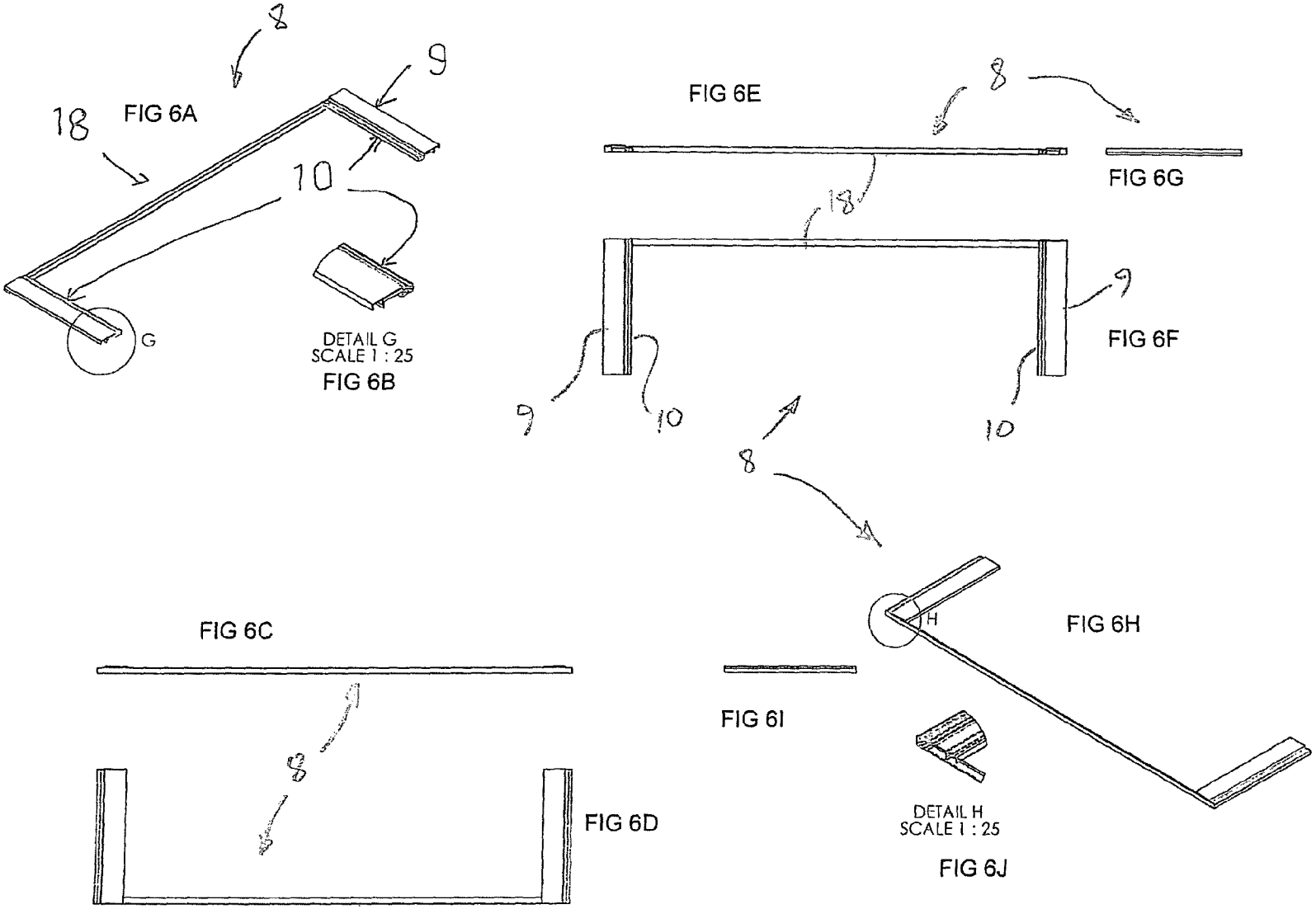
FIG. 6 shows detail of a module runner.
Figure 7:
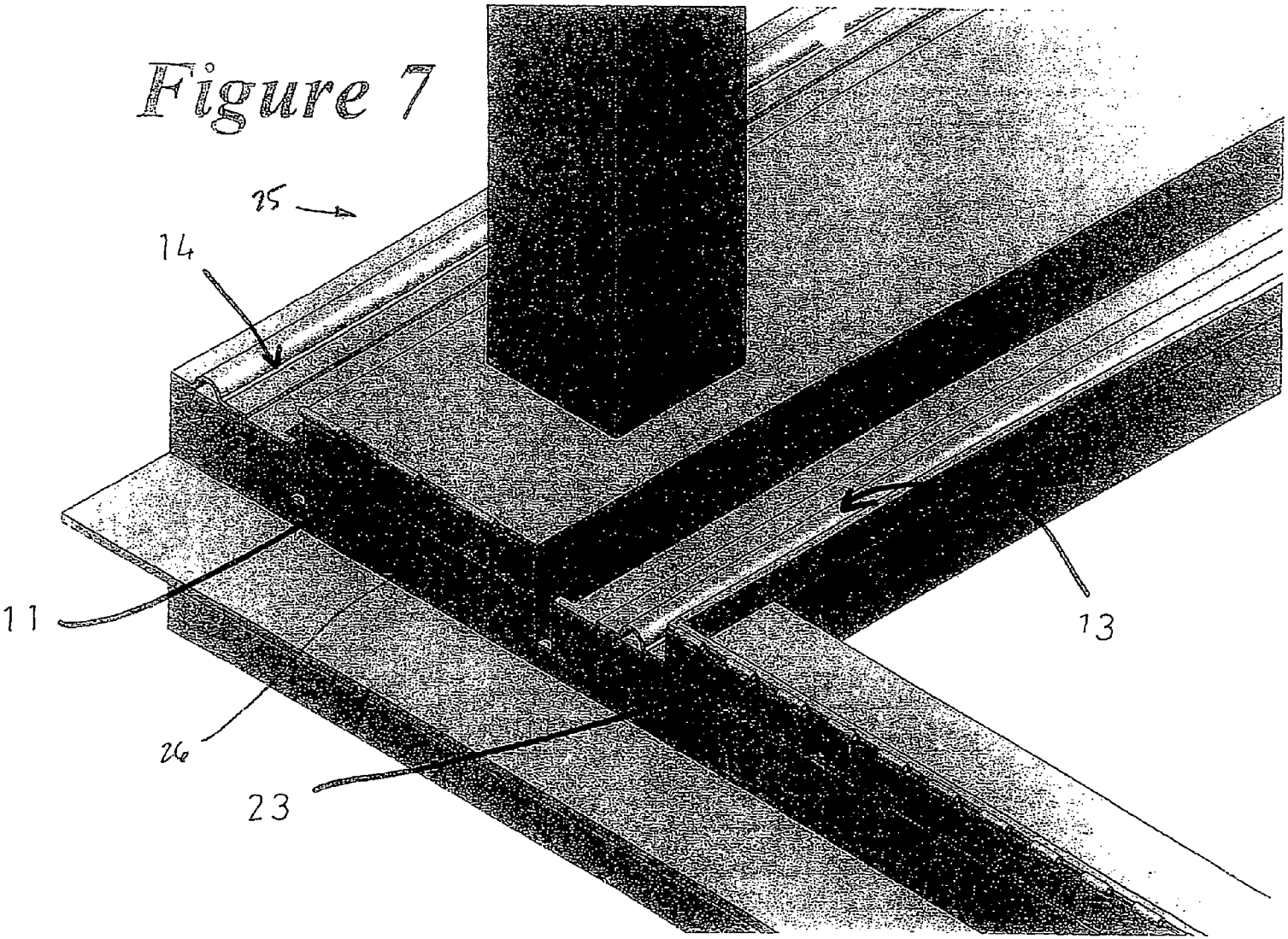
FIG. 7 shows a close-up of track detail for the central module.
Figure 8:
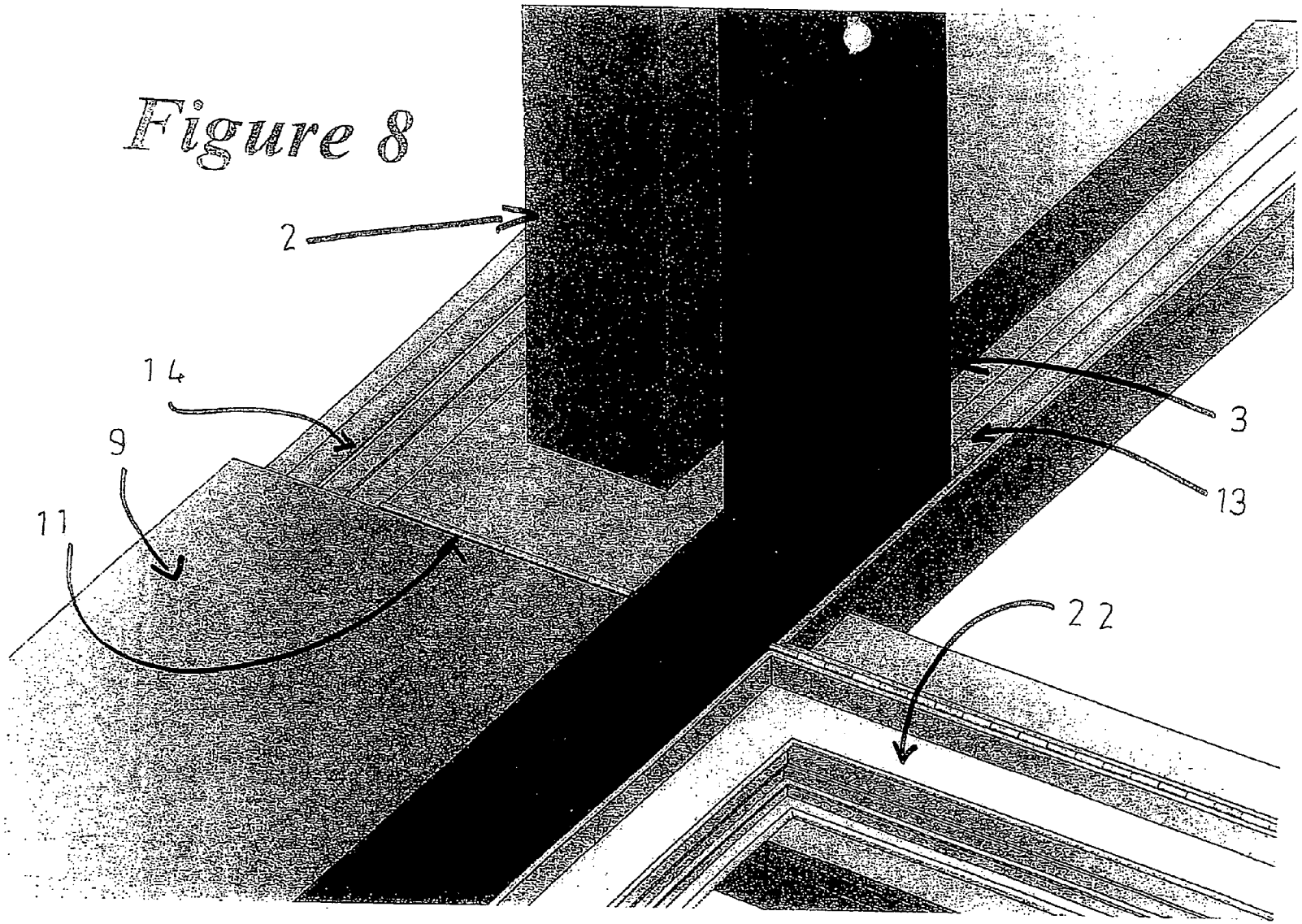
FIG. 8 shows a close-up of the interface between the central module, internal module, floor panel and tracking.
Figure 9:
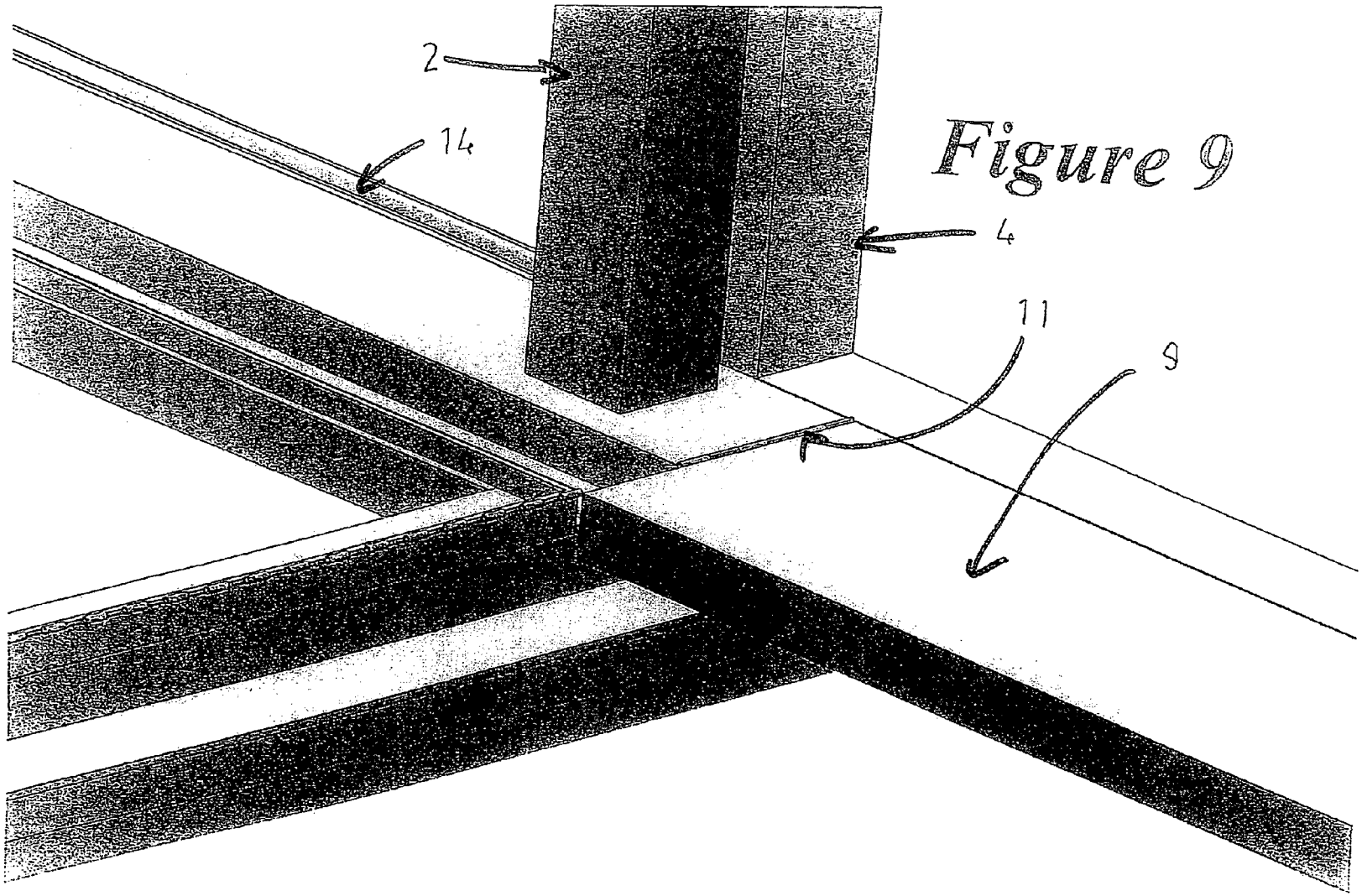
FIG. 9 shows detail of the interface between the central module, external module and module runner.

Referring now to FIG. 6, the structure 1 includes two module runners 8 which are hingedly connected to either side of the central module 2 and fold down so as to provide a tracking facility for the internal and external modules. The module runner 8 includes two runner arms 9 either side thereof, each including an integral runner track 10 with the runner arms 9 optionally being joined at the remote end by a runner brace 18. The co-operation between the module runner 8 and the central module 2 is shown in detail in FIG. 8 where the runner hinge 11 connects the near end of the runner arm 9 to the side of the central module 2 so as to align the runner track 10 (not visible) with the internal central track 13 of the central module 2. This configuration allows the smooth and seamless sliding of the internal module 3 into the confines of the central module to adopt the first closed and transportable configuration of the structure and then to adopt the second open habitable configuration the internal module slides out of the confines of the central module 2 so as to assume its own space adjacent the space of the central module 2.

In an analogous fashion, a runner arm 9 is fitted to the other side of the central module 2 and provides mirror image runner track 10 so as to co-operate with the external central track 14 of the central module 2.

Once the internal and external modules 3 and 4 have been drawn away from the central module 2, they are fully supported on the module runner arms 9 with suitable wheels or rollers incorporated with the lower brace 12 of the respective external and internal module. With the internal and external modules 3 and 4 drawn out from the central module 2, the hinged load bearing floor inserts 19 can be folded down to sit within the confines of the module runner 8 by placement on mounts 22, thereby allowing the preparation of a load bearing floor following exactly the same levels with the central module integral floor 5. The floor panels may be extended to lie flat before the internal and external modules 3, 4 are expanded outwardly. Alternatively, in some embodiments, the floor panels may be configured to be positionable in the extended flat position after the modules have been extended. In this way, the internal, central and external modules can be caused to have a floor on one seamless level, thereby effectively expanding out the capacity of the central module to triple the size of the transportable structure. The floor inserts (each of which acts as a floor tile) are each fully load bearing and the provision of multiple inserts allows handling by a single operator as each insert is of a manageable weight compared to a unitary floor.

In order to maximise the modular capacity of the structure 1, the side portion 7 of each of the modules include side braces 15. The side braces are of varying position in accordance with the internal, central or external module so as to present side portion 7 of the same dimension for each of the internal, central and external modules.

In a similar manner, end braces 16 are provided for the end portions of the respective modules so as to allow the insertion of vertical stanchions at fixed positions to present end portions of the same dimension as the side portions thereby allowing the insertion of windows, doors etc of a uniform dimension.

Described embodiments of structure 1 advantageously provide a manually operable expanding and transportable habitable structure which can be readily and quickly moved by one or two persons from the first closed transportable configuration to the second open habitable configuration by the release of the side module runners 8 which are hinged down and then levelled in accordance with the level of the central module 2. The light weight of the modules, plus the sliding runners, allows ready manual erection by a single person without the need for motorised assistance. However, different (e.g. larger) versions of the structure 1 (and other structure embodiments described herein) may be equipped with optional motors and mechanical assistance if required. Once the module runners are lowered down and levelled, the respective internal and external modules can be drawn out by smooth running along the module runner tracks. Suitable stop means 20 are provided to the central module and internal module thereby preventing overrunning of the external and internal modules respectively, relative to the central module. The stops 20 may also incorporate weather seals to ensure the opened structure is proofed against wind and rain. In this manner, the structure 1 can be competently drawn out by one or two persons without fear of overreaching the expansion capacity of the structure 1.

In addition to the ease of use and assembly, the structure 1 provides modular features of its own design. In particular, the open configuration of the structure 1 provides an interference free walkthrough room with the effective capacity of the three modules, with each of the modules having open end portions 21 allowing free movement throughout the open structure. When a single structure is required, the roof portion, side portions and the end portions can be fitted with windows and doors of the desired configuration so as to form a secure and sealable structure. However, in the event that multiple structures are required, embodiments allow for the placement and abutment of multiple structures 1 end to end providing a room of limitless length by the simple placement of a plurality of the structures 1 abutting each other.

The light weight of the structure provides for ease of transport which can be effected by a range of standard road vehicles including utilities, pick up trucks or trailers.

An optional modification according to some embodiments may incorporate road conforming wheels as an integral part of the central module providing ease of transport by hitching to any road vehicle. Alternatively, the central module may be provided with fork lift tine mounts incorporated into the floor bearers 17 to assist in handling of the non-wheeled option.

The structure 1 of described embodiments can provide full compliance with public event area requirements for structural soundness and load bearing capacities.

In embodiments of the structure 1 shown in FIGS. 1 to 9, the central module 2 forms a fixed part of a base unit 25 that includes the rigid frame and roof of the central module 2 and a base 26, which comprises a fixed floor and floor frame. The module runners 8 and fold out floor parts 22 may be coupled to the floor frame of the base 26. The base unit, once positioned relative to ground supports, becomes fixed in position while other modules move relative to thereto between the open and closed positions. As is shown and described in relation to various embodiments below, the base unit can be configured to comprise a frame module other than the central frame module.

Figures 10A, 10B:
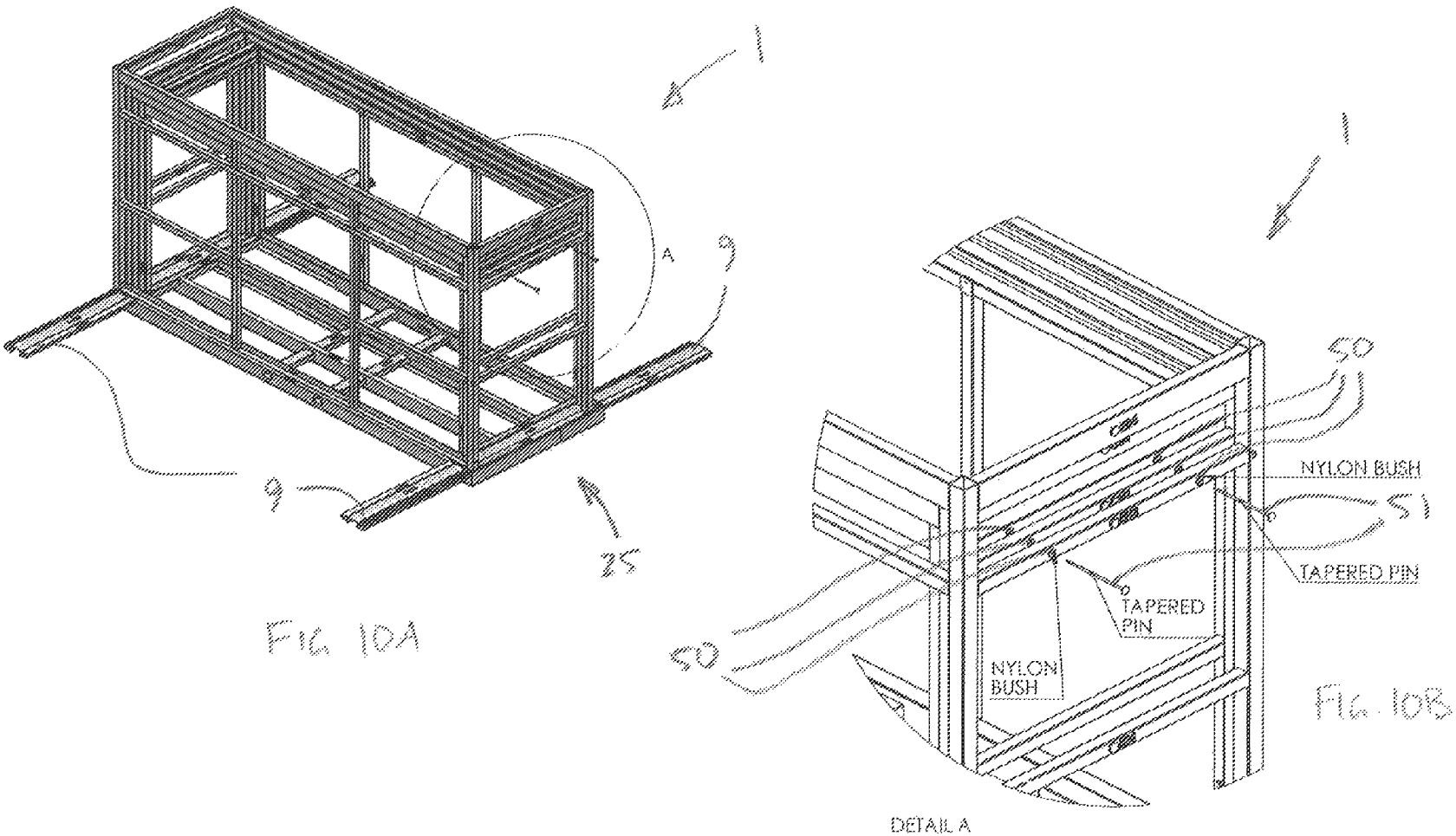
FIG. 10A is a perspective view of the structure according to some embodiments in a closed, contracted configuration, but with module runners folded down for expansion.
FIG. 10B is a detailed view of Part A of FIG. 10A.
Figures 11A, 11B:
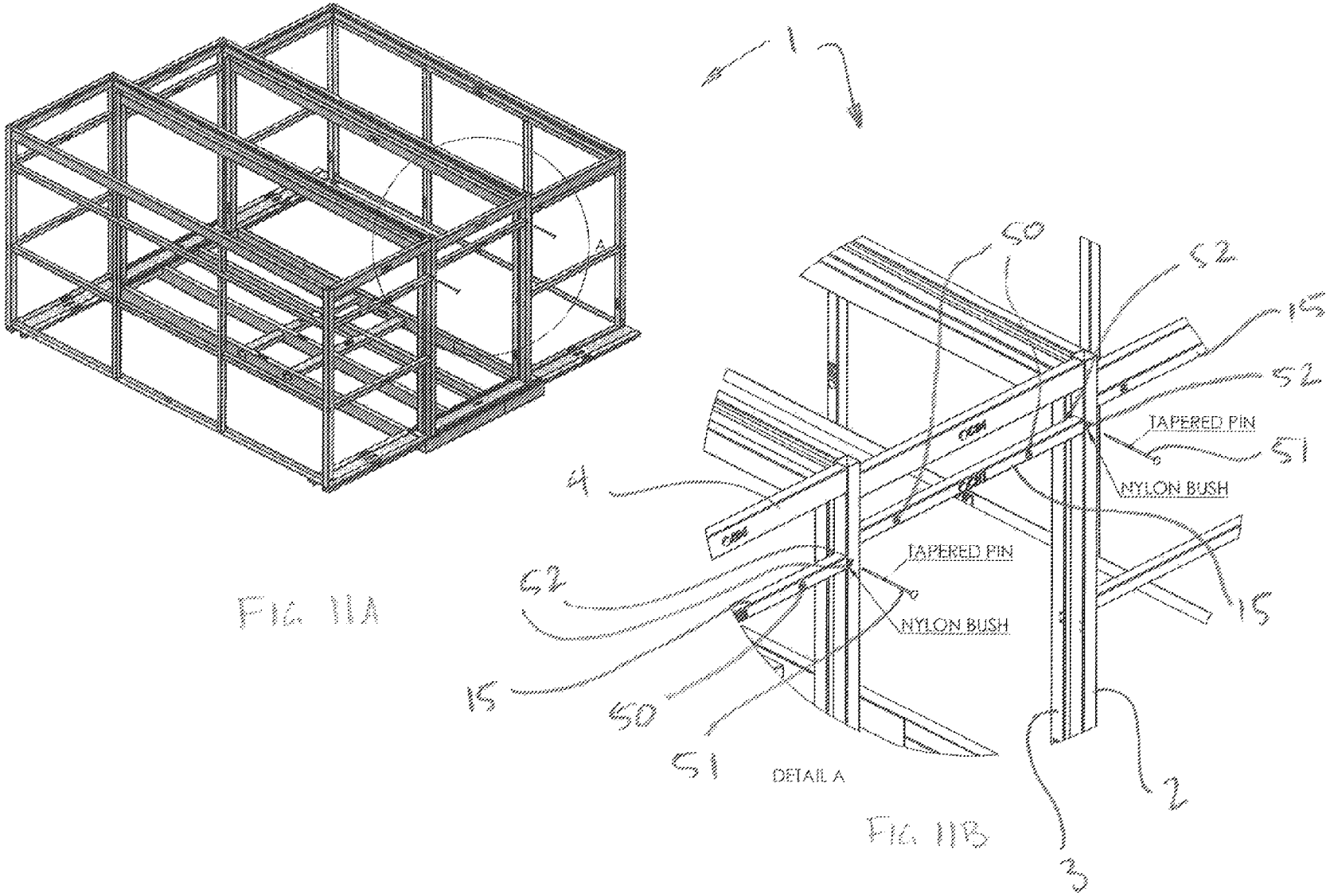
FIG. 11A is a perspective view of the expandable building structure according to some embodiments, shown in an open, expanded configuration.
FIG. 11B is a detailed view of Part A of FIG. 11A.

Referring to FIGS. 10A, 10B, 11A and 11B, embodiments of the expandable building structure 1 can be held in the closed position, as shown in FIGS. 10A and 10B, or in the extended open position, as shown in FIGS. 11A and 11B, by use of appropriate fixation means. Such fixation means may include the use of tapered pins or rods 51 extending through apertures 50 in frame elements, such as side braces 15, of the central, internal and external modules 2, 3 and 4, for example. The apertures 50 may be defined by nylon bushes fixedly received in the frame elements, for example. Sets of apertures 50 in the frame elements are aligned when the structure is in the closed contracted position, as shown in FIGS. 10A and 10B, so that a pin or rod 51 can be inserted manually through a plurality of sets of aligned apertures 50 to affix the structure in the closed position at a number of different points around the structure and substantially prevent or minimise movement of the modules between the open and closed positions.

In order to keep the expandable building structure in the expanded position, different sets of apertures 52 in the frame elements become aligned with each other for receipt of fixation rods or pins 51 that serve to substantially prevent or minimise relative movement of the modules. FIG. 11B illustrates the pinning of outer frame parts of the internal and external modules 3, 4 to adjacent outer frame parts of the central module 2 to affix the structure 1 in the open position. In other embodiments, other suitable fixation means may be used to positionally fix the structural modules relative to each other and to the base of the structure.

Figure 12A:
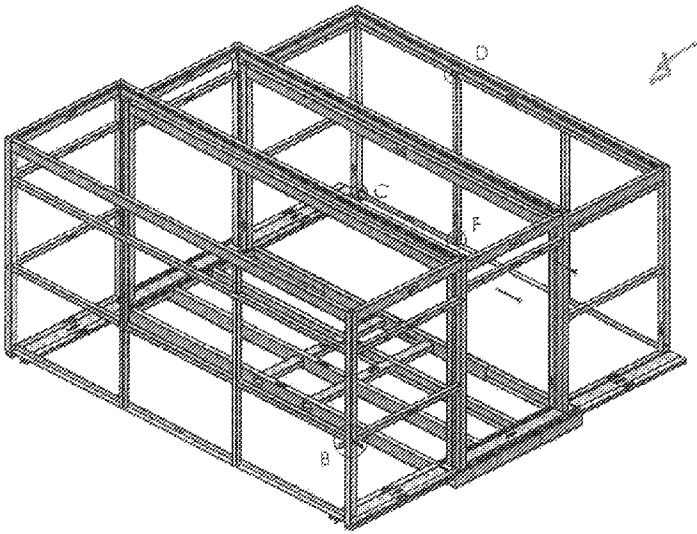
FIG. 12A is a perspective view of the structure of FIG. 11A, acting as a key for more detailed views of Parts B, C, D and F, shown in FIGS. 12B, 12C, 12D and 12E respectively.
Figure 12B:
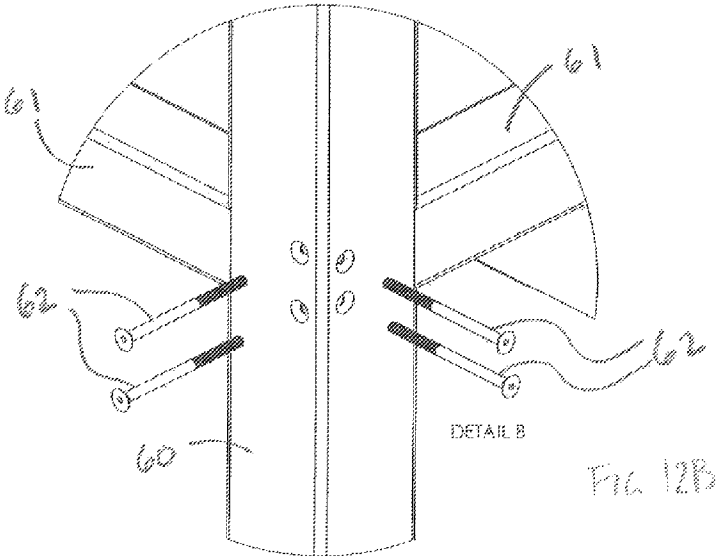
Figure 12C:
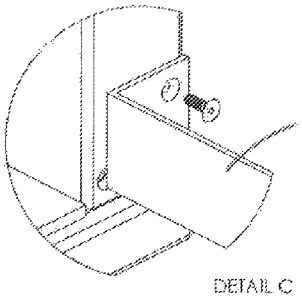
Figure 12E:
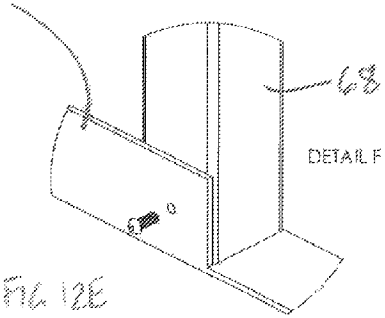
Figure 12D:
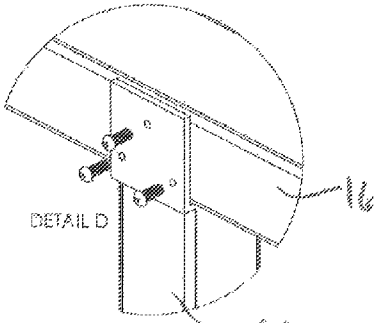
Figures 13A, 13B, 13C, 13D, 13E:
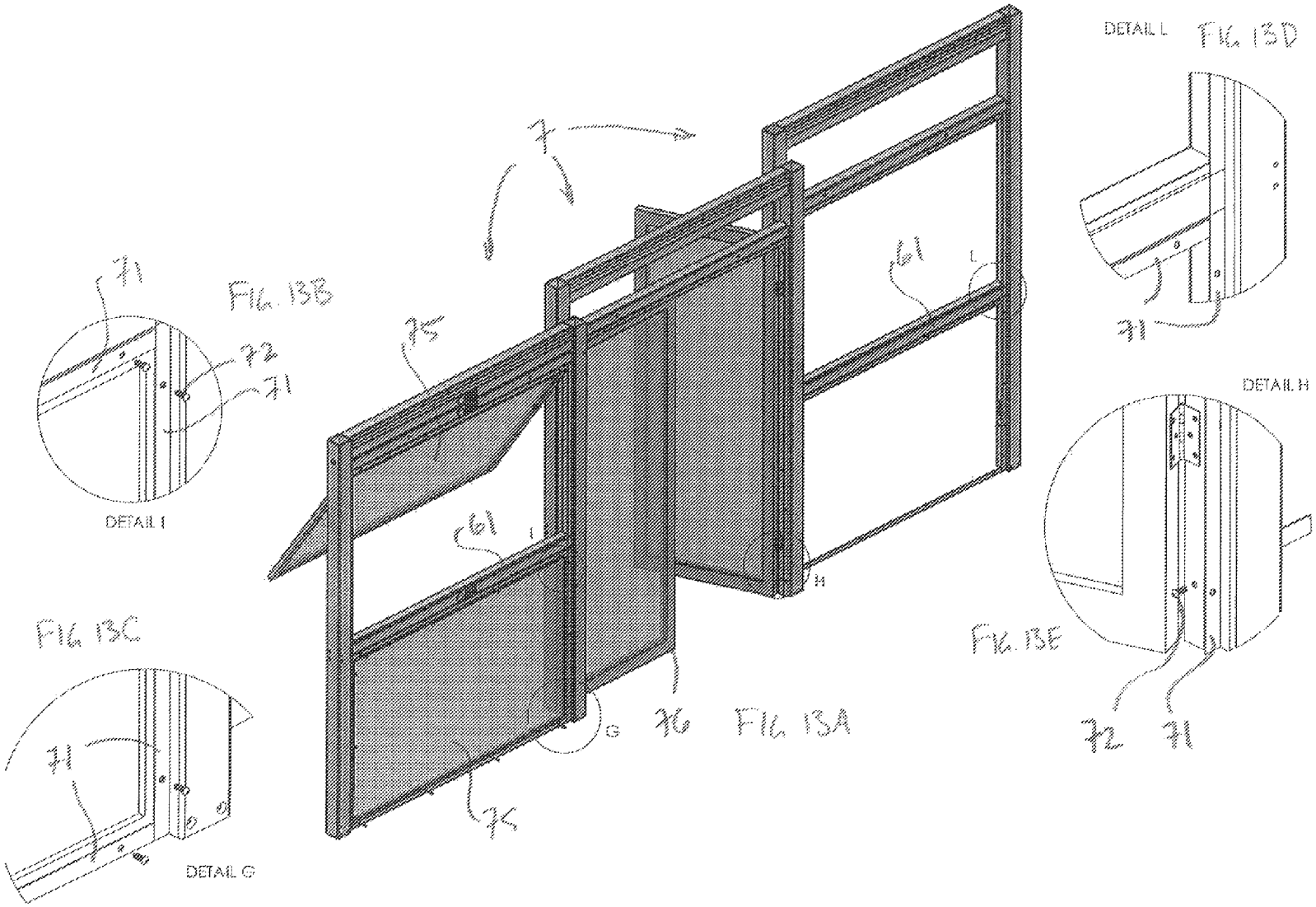
FIG. 13A is a perspective view of side structures of the expandable building structure, shown in an expanded position.
FIG. 13B is a detailed view of Part I of FIG. 13A.
FIG. 13C is a detailed view of Part G of FIG. 13A.
FIG. 13D is a detailed view of Part L of FIG. 13A.
FIG. 13E is a detailed view of Part H of FIG. 13A.

Referring also now to FIGS. 12A, 12B, 12C, 12D and 12E, example connection mechanisms are shown and described, by which lateral cross bar members 61 can be coupled to the vertical posts 60 that are positioned at each corner of each module and vertical stanchions 68 can be coupled to end braces 16 that extend lengthwise along an upper part of the internal and external modules. For example, in the long open spaces of end portions 21, vertical stanchions 68 can be fixed, for example by fasteners in the manner shown in FIG. 12D, at spaced positions across the open area of end portion 21 to define module insert regions of a same height and width dimensions (or an integer multiple of one or both of the same height and width dimensions) as those defined by the side portions 7. In other words, the insert regions have an open area that can receive an insert of a fixed area (height by width) and the insert regions may be formed as a full size or a half size (depending on whether a central horizontal cross-bar 61 has been connected across the full size insert region, which would effectively form two half-size insert regions). For example, end portions 21 may have two vertical stanchions 68 extending between end brace 16 and a bottom lateral connection bar (as shown in FIG. 12E) so that three substantially rectangular voids are defined with the same dimensions as the rectangular voids defined underneath the side braces 15 in side portions 7. Such rectangular voids may additionally be crossed (and thereby divided) by centrally positioned lateral cross bars 61 and connected to the vertical stanchions 68 or the corner posts 60 by suitable connection means, such as screw threaded fasteners 62 received in suitable sized apertures, as shown by way of example in FIG. 12B.

The positioning of vertical stanchions 68 and cross bars 61 within the generally rectangular cuboid frames of each module serves to allow highly modularised and interchangeable inserts for easy custom configuration of the expandable structure to suit a particular preferred use. For example, as illustrated in FIGS. 13A, 13B, 13C, 13D and 13E, the space defined between the side brace 15, the vertical corner posts and the floor of each module can be used to receive a modular door, window or wall insert 75, 76 of a predetermined size or a proportion of that size, such as roughly one half (or possibly one third) when a cross bar 61 is used to vertically divide the space. Although the total height of each of the central, internal and external modules 2, 3, 4 is different, the modularisation of the inserts is achieved by having the side braces 15 and end braces 16 be at the same height all the way around the modules and by having the lateral width of each of the modules 2, 3, 4 be the same. Similarly, as shown in FIG. 1, the longitudinal width of the space underneath end braces 16 and end portions 21 can be kept the same dimensions in the outside part 21 of the external module 4 as in the outside part 21 of the internal module 3.

Figure 14A:
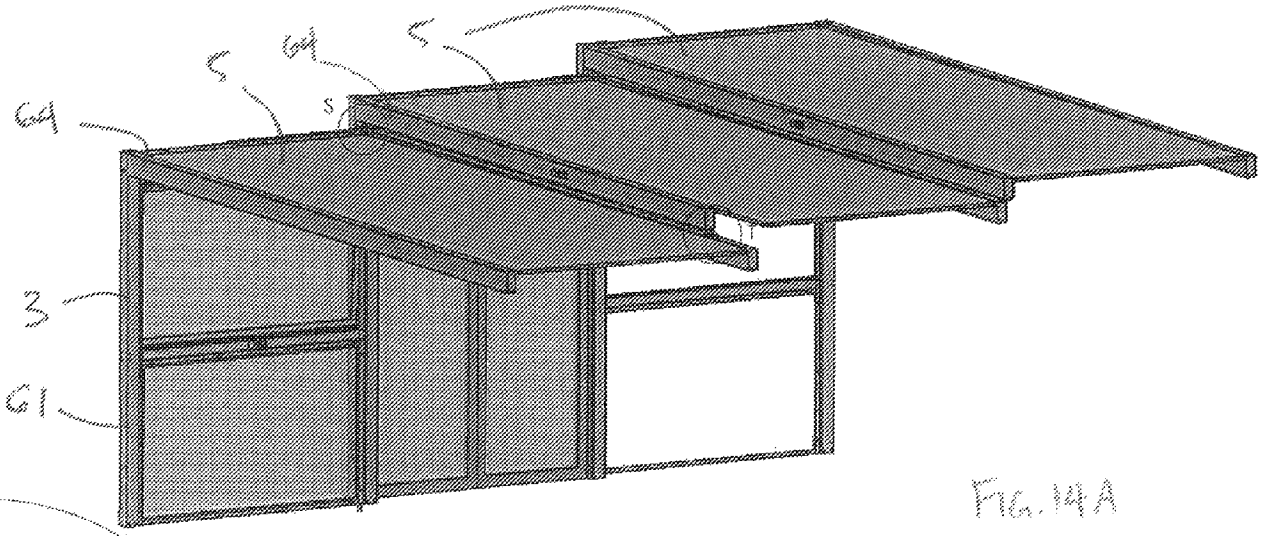
FIG. 14A is a perspective partial cutaway view of part of an expandable building structure according to some embodiments, shown in an open, expanded position.
Figure 14C:
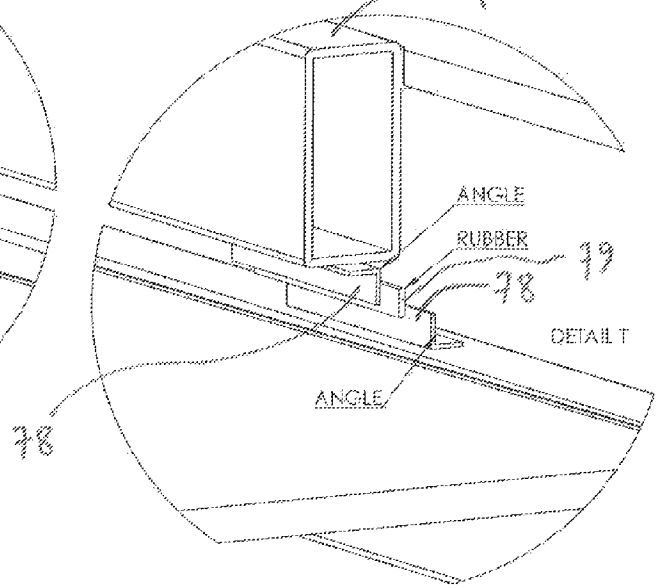
FIG. 14C is a detailed view of Part T of FIG. 14A.
Figure 14B:
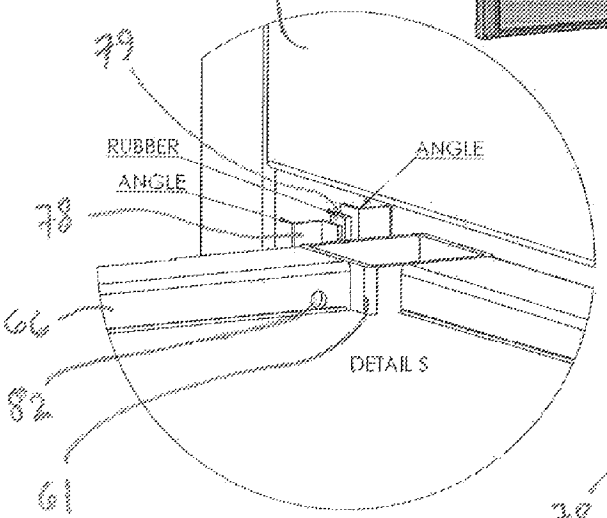
FIG. 14B is a detailed view of Part S of FIG. 14A.

As shown in FIGS. 14A, 14B and 14C, embodiments of the expandable building structure advantageously can provide a substantially weatherproof enclosure, with abutting sealing portions 78 positioned to generally mitigate significant ingress of air or water between the rooves or signs of the modules when the structure is in the expanded position. In addition to generally abutting angled plates 78 coupled to outside edge areas of the modules (and acting as suitable stop means 20 to hinder over-extension), sealing strips 79 formed of rubber or other suitable materials can be used to hinder ingress of air or water inside the structure.

Figures 15A, 15B, 15C, 15D, 15E, 15F, 15G:
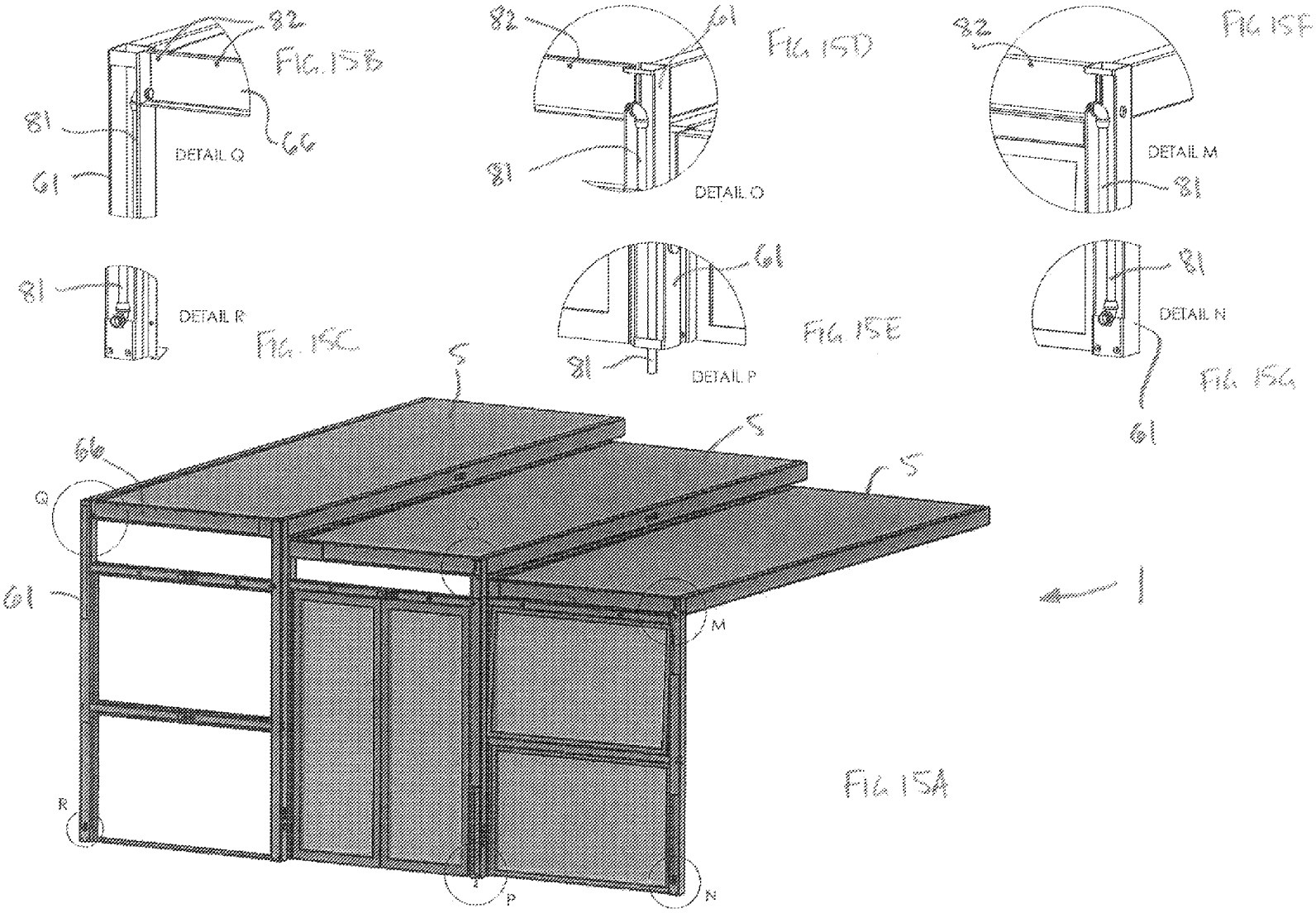
FIG. 15A is a perspective partial view of roof and side sections of an expandable building according to some embodiments.
FIGS. 15B and 15C are detailed views of Parts Q and R respectively, illustrating example drainage structure.
FIGS. 15D and 15E are detailed views of Parts O and P of FIG. 15A, showing example drainage structure for a centre module.
FIG. 15F and FIG. 15G are detailed views of Parts M and N, respectively, of FIG. 15A, showing example drainage structure of the internal module.

According to further embodiments, the expandable building structure may have drainage structure to allow water to drain from a roof 5 of each of the modules. Such drainage structure is shown by way of example in FIGS. 15A, 15B, 15C, 15D, 15E, 15F and 15G. Each of the grooves 5 of the modules is slightly sloped from one end to the other, so that water runs downwardly toward that one end. Apertures 82 may be formed in a top cross bar 66 at the downward end of the roof of the module, as is visible in FIGS. 15B, 15D and 15F, to allow water to pass therethrough from the roof 5 into a drainage channel defined in that lateral cross member 66. At one end of each top lateral cross member 66 of each module, a drainage conduit 81 is positioned with an opening to receive and channel away water that has flowed into the drainage channel. Such drainage conduits 81 extend internally within one of the corner posts 60 of each module from near the top down to a position near a base of the corner post 60 or optionally to a drainage location underneath the floor level of the expandable building structure 1. Thus, the drainage structure of the expandable building structure 1 is generally concealed and conveniently directs water to a low drainage location for suitable disposal.

Figures 16A, 16B:
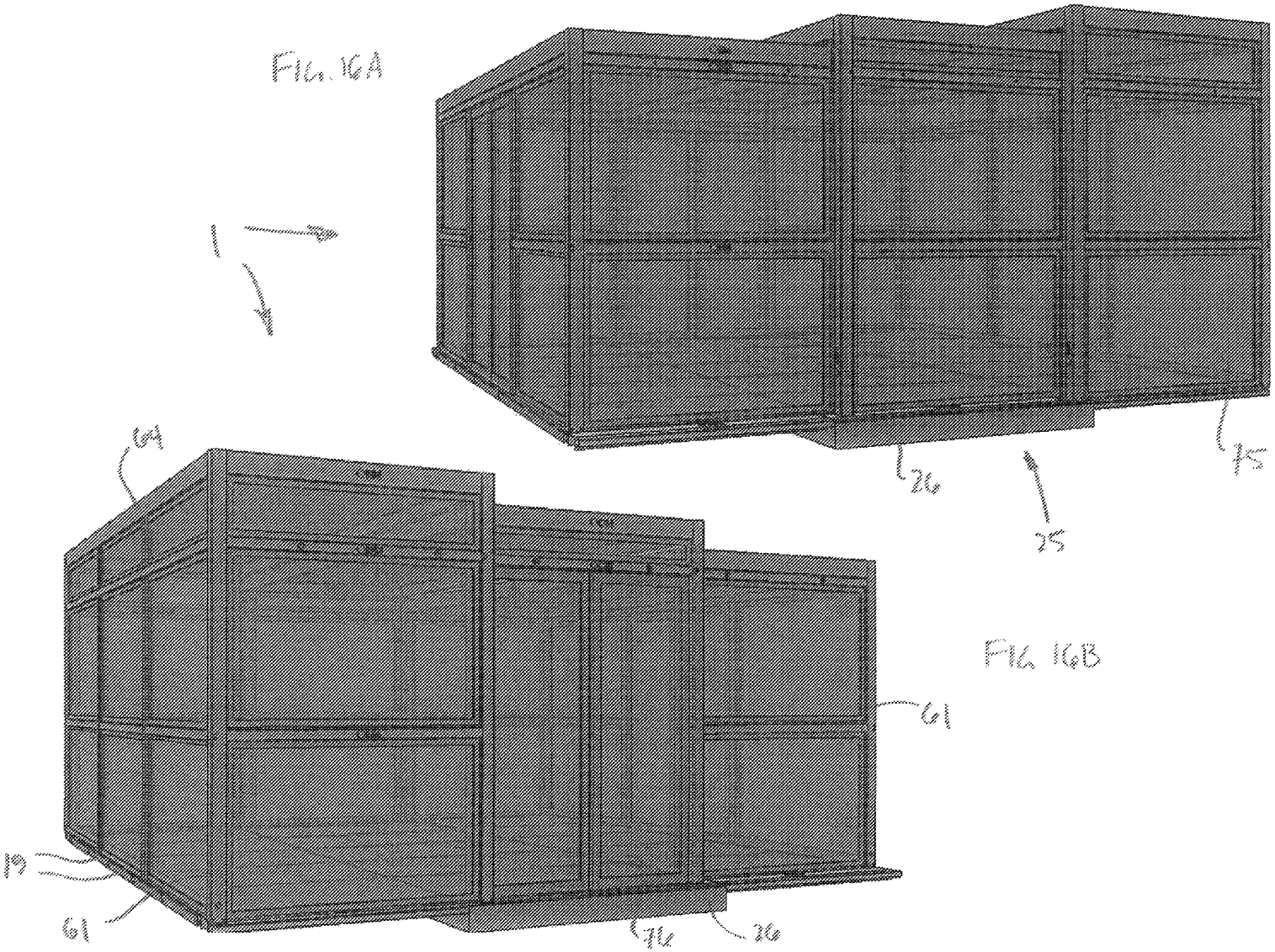
FIGS. 16A and 16B are perspective views of an expandable building structure according to some embodiments, shown in an expanded, open position and illustrating embodiments in which the centre module forms part of a base unit of the building structure.

FIGS. 16A and 16B show perspective views of example embodiments of the expandable building structure 1 in its open, expanded state and with the floors down and the modular window and door inserts in place, thereby defining an enclosed interior space that is unobscured by internal walls and allows free roaming occupancy throughout the space. The floors throughout the expandable building structure are built to withstand full human occupancy and may be loaded to 500 kgs per square meter. The various vertical posts, beams and stanchions and horizontal beams and cross bars may advantageously be formed of aluminium so that the erected building structure has a light weight and strong construction, making the building eminently transportable and easier to manually erect and put away. However, other light-weight and durable materials can be used in place of Aluminium. Alternatively, a stronger and heavier material, such as steel, may be used. Suitable metal alloys may also be used to form the beams, poles and stanchions.

Exemplary embodiments, such as those shown in FIGS. 16A and 16B, may have a lateral and longitudinal width in the order of about 6 meters in the expanded configuration (and about 2.5 to 3.5 m in height). However, some variation in such dimensions can be accommodated. At least some embodiments are sized and configured to be towable behind a suitable vehicle without the need for incurring wide load management protocols. It is envisaged that in some embodiments, the expandable building structure may be up to 12 m in length instead of 6 m (while remaining at about 2 to 2.5 m in width in the closed contracted configuration and roughly 6 m in width in the open configuration). Further, some embodiments may be sized to have floor plan dimensions in the open configuration of approximately 3 m×3 m. Regardless of size, it is intended that all such embodiments be configured to accommodate modular inserts of windows, walls and doors by providing suitably sized module frame openings that have the same size openings in the major side or end walls, or at least some of the side or end walls have the same sized openings, while other side or end walls have the same size as each other but with a different total area from the first openings. For example, some openings may be sized to receive a window insert that is about half of the area of other openings that are sized to receive a door frame insert.

In order to assist in readily connecting the modular window, wall and door inserts 75, 76, each of the upright poles or beams 60 (including inserted vertical stanchions 68) around the outer periphery of the expanded structure has right-angled frame elements or structures 71 to which the inserts can be readily coupled by means of suitable fasteners, such as screws 72 or clips. Similarly, all lateral cross bars 61 have similar right-angled frame elements 71 affixed thereto. In this way, when a window, wall or door insert 75, 76 is to be affixed in place in one of the various modularised insert-receiving spaces defined by the structure, the insert can simply be placed to be closely adjacent the vertical and horizontal frame elements 71 and affixed by means of suitable fasteners.

In some embodiments, the total lateral width of the closed and contracted building structure is less than or equal to 2.5 m, while the maximum height of the building structure is selected so that, on a standard wheeled trailer, the total height of the trailer and the building structure is less than or equal to 4.3 m from the ground.

Figure 17:
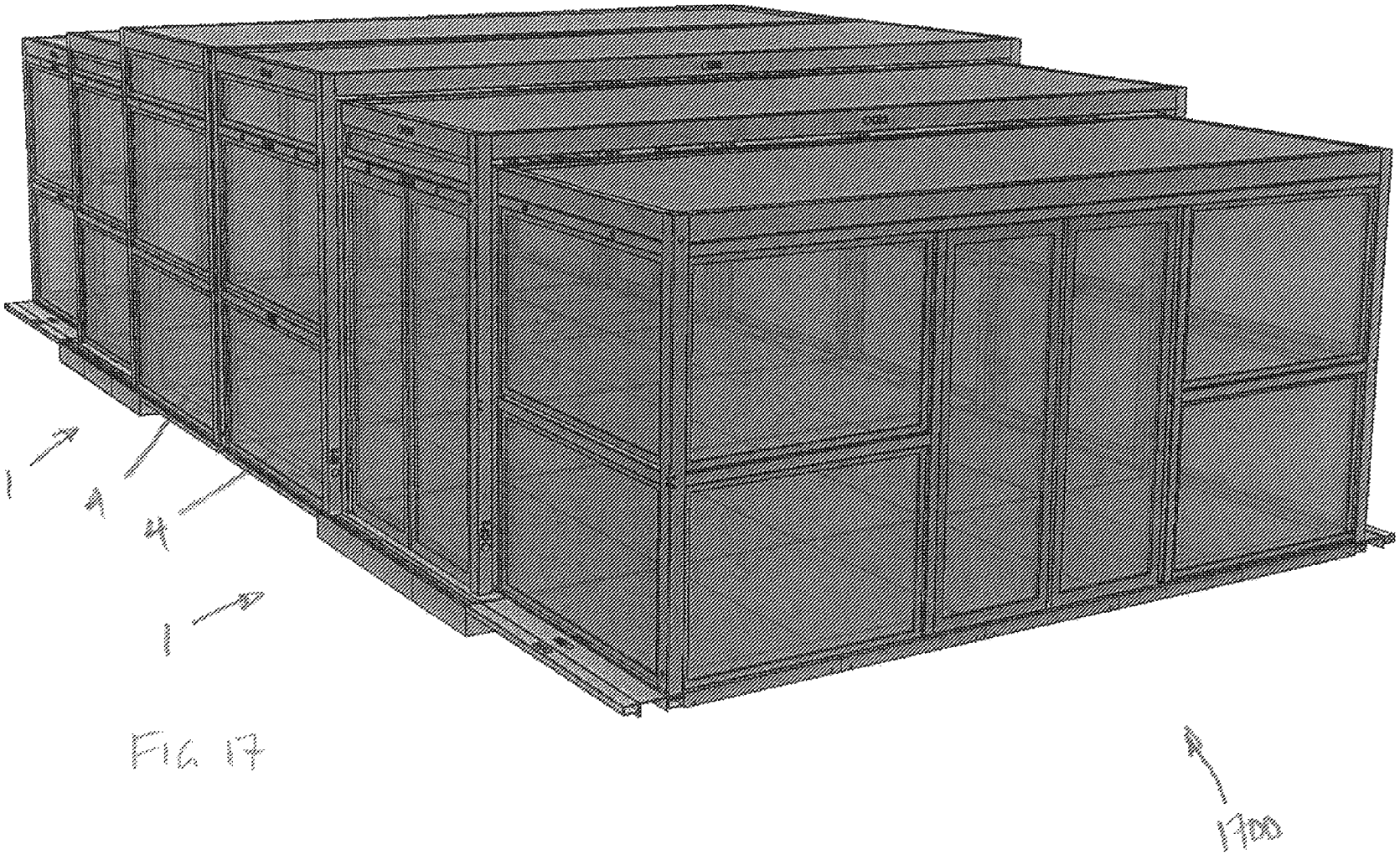
FIG. 17 is a perspective view of an expandable building structure according to further embodiments showing a plurality of the structures of FIGS. 16A and 16B joined and opened to each other at one end, thereby forming an enlarged expandable building structure.

Referring now to FIG. 17, there is shown an expanded building structure 1700 comprising two of the expandable building structures 1 shown and described in relation to FIGS. 1 to 16 placed adjacent to each other, with end portions 21 of the adjacently located external modules 4 of the two structures having no windows or doors positioned therein. In this way, the two structures 1 positioned side by side and each fixed in the open positions effectively constitute an expanded building structure 1700 having twice the internal floor space and occupiable area than one of those structures would have alone. This concatenated form of building structure can be described as a side to side concatenation or an end to end concatenation, but essentially the base units of the central modules are arranged in parallel, rather than in a line, so that a free flow of space can be readily obtained through the open end portions 21 of each of the adjacently positioned internal or external modules 3 or 4.

Although FIG. 17 illustrates an example expanded building structure 1700 in which the external modules 4 of the two structures are positioned adjacent to each other, this could also be done with the internal modules 3 being adjacent to each other. In fact, the expandable building structure 1 is designed so that 2, 3, 4, 5, 6, 7, 8, 9, 10 or more such structures may be aligned with each other, with each adjacent pair of expanded structures 1 having their external modules 4 positioned next to each other or their internal modules 3 positioned next to each other, so that there is no height disparity between adjacent connecting modules 3 or 4 of separate expanded building structures 1. The ability to serially concatenate such building structures 1 is enabled by the modular construction of each such expandable building structure 1, with end portions 21 being able to be free of any vertical stanchions 68 through the centre thereof. Such an arrangement also allows all of the floors of the serially concatenated expanded building structures 1 to be level with each other, assuming that suitable level ground is provided underneath the base of the expanded building structures.

Figure 18A:
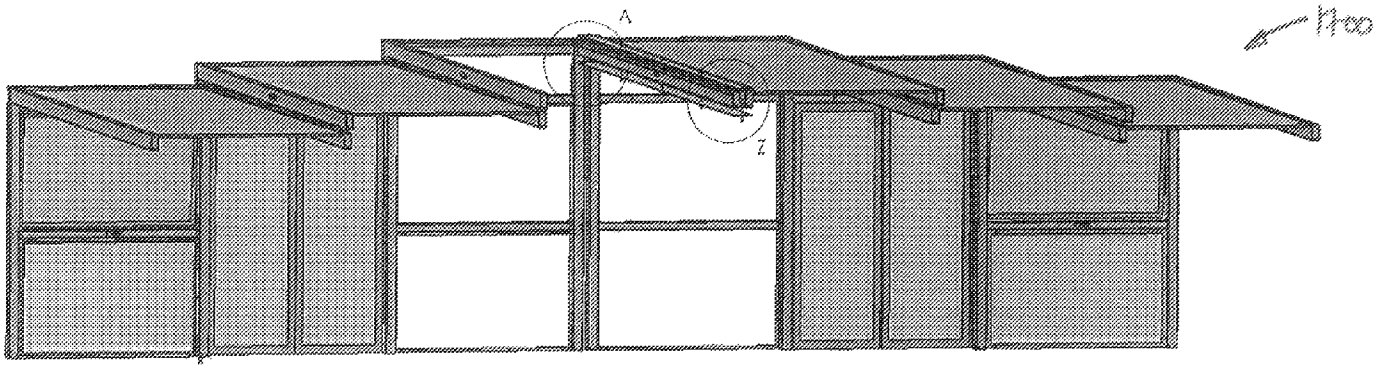
FIG. 18A is a perspective partial cutaway view of the expandable building structure of FIG. 17, illustrating the sealing and joining of separate expandable building structures together at a top section thereof.
Figure 18C:
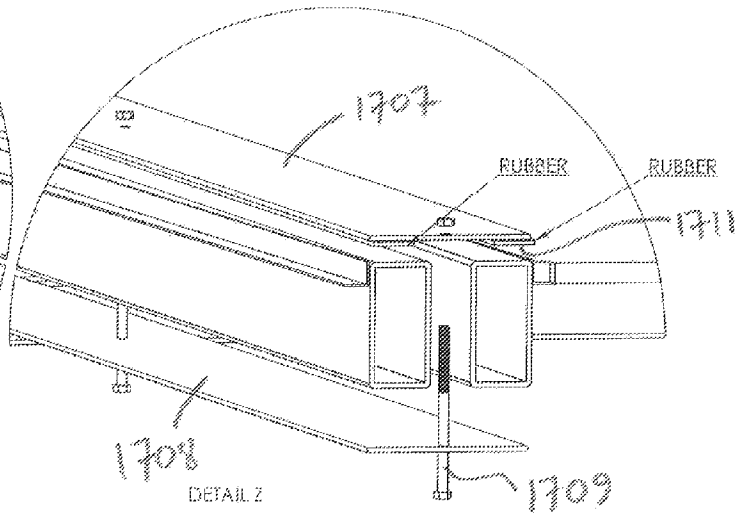
FIG. 18C is a detailed view of Part Z of FIG. 18A.
Figure 18B:
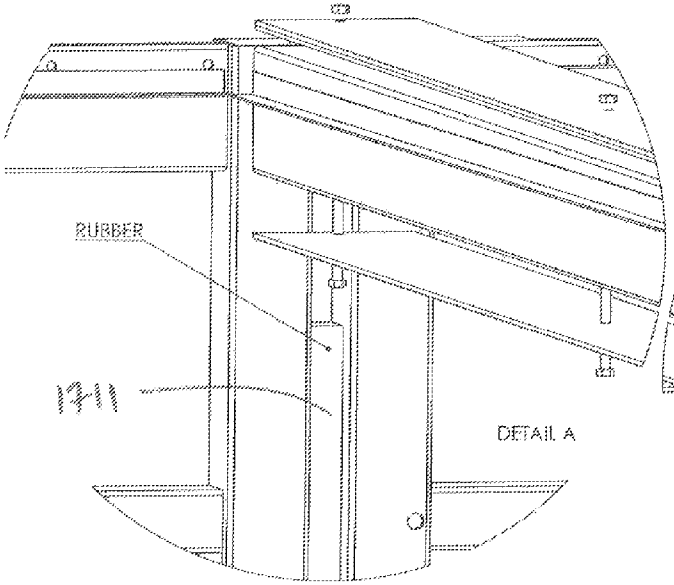
FIG. 18B is a detailed view of Part A of FIG. 18A.
Figure 19A:
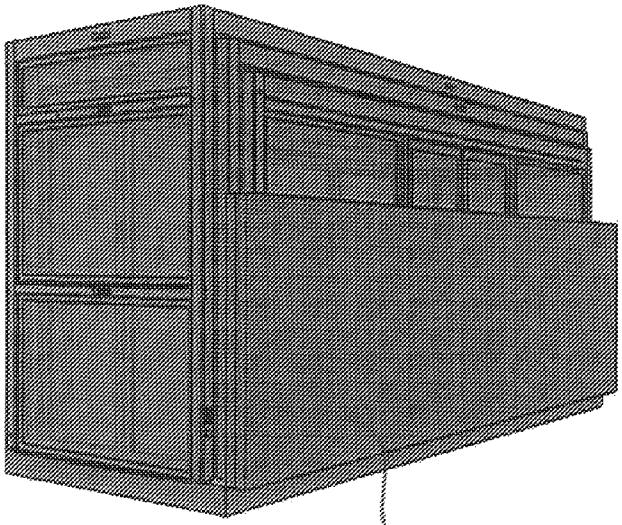
FIGS. 19A and 19B are perspective views of an expandable building structure according to further embodiments, with the structure shown in a closed, contracted position.
Figure 19B:
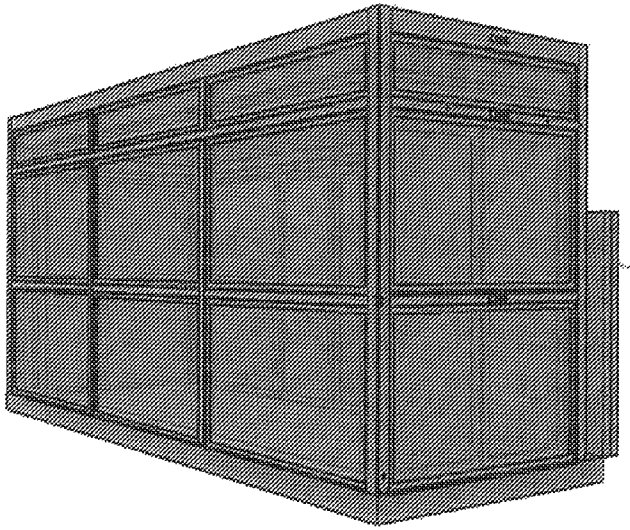

FIGS. 18A, 18B and 18C illustrate an example coupling structure to couple adjacent modules of separate expandable building structures 1 to each other to form the multi-unit expanded building 1700 shown in FIG. 17. The adjacent lengthwise beams of the external modules 4 (as the example shown in FIGS. 17 and 18) do not need to directly abut each other but to be slightly separated and remain parallel, so that upper and lower sealing plates 1707, 1708 can be coupled to each other by fasteners extending in the space between the adjacent parallel cross members 64. Such fasteners may include threaded bolts 1709 cooperating with nuts, for example, to clamp the upper and lower plates 1707, 1708 together and thereby provide a seal against ingress of water. Rubber or other suitable sealants may be used to provide sealing strips 1711 or gaskets to assist in sealing functions. Although FIGS. 18A, 18B and 18C show generally horizontal sealing plates to be positioned at the level of the upper lengthwise cross beams 64, similar sealing arrangements are provided along the sides and bottom areas where the horizontal and vertical beams of the adjacent external modules 4 are positioned closely to, but slightly spaced from, each other. Alternatively, other suitable coupling structures may be provided that allow for suitable sealing against ingress of water between the two adjacent external modules (which may in other embodiments be the internal modules 3).

FIGS. 19A, 19B, 20A, 20B, 21A, 21B, 22A and 22B illustrate in sequence expansion of an expandable building structure 1900 according to some embodiment from a closed, contracted stated to an open, expanded state. The expandable building structure of such embodiments has the external module as part of the base unit 25, with the central and internal modules 2, 3 moving away from the external module 4 in a telescoping manner as the expandable building structure 1900 transitions to the open expanded state.

Figure 20A:
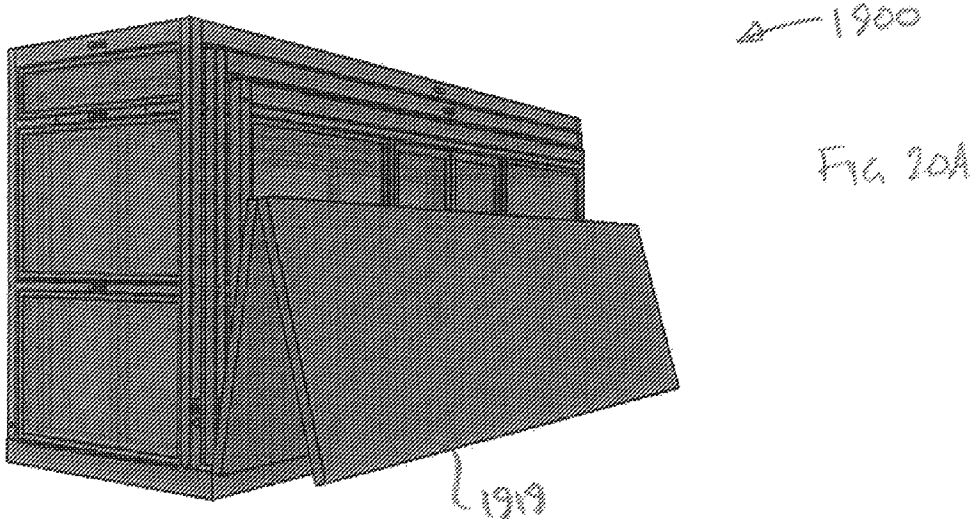
FIGS. 20A and 20B are perspective views of the expandable building structure of FIGS. 19A and 19B, showing partial deployment of floor parts of the structure toward an open position.
Figure 20B:
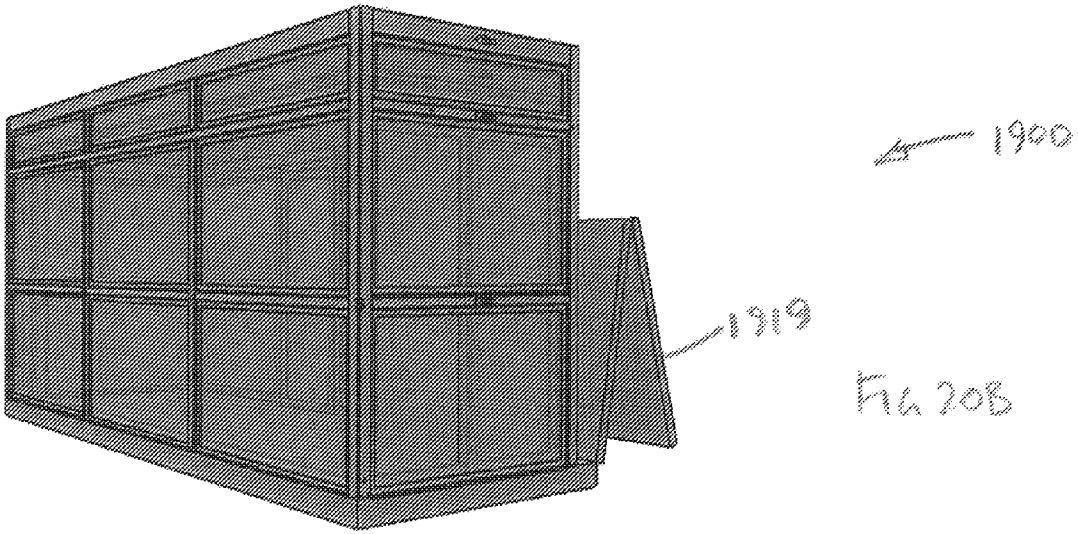
Figures 21A, 21B:
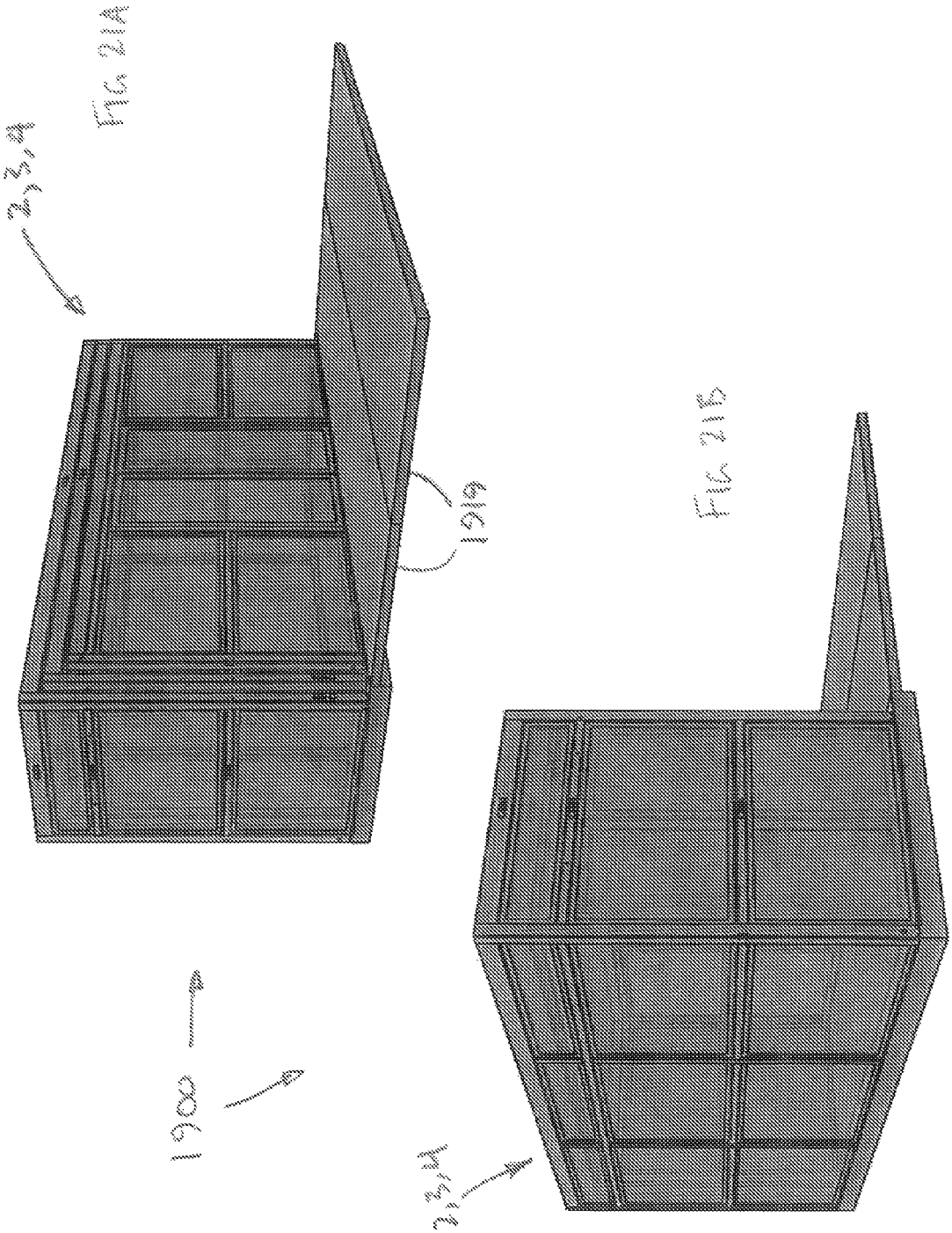
FIGS. 21A and 21B are perspective views of the expandable building structure of FIGS. 19A and 19B, showing the floor parts in an open deployed position.

Because the central and internal modules 2, 3 telescope outwardly in a single direction (perpendicular to the longitudinal axis of the base unit 25), a modified floor panel and module runner arrangement is needed for these embodiments, as compared to the embodiments shown and described in relation to 1 to 16, which expand on both sides. As is visible in FIGS. 19A and 19B, floor parts 1919 of the expandable building structure 1900 may be folded up flat against the outside of the internal module when the structure is in the closed position. These floor parts 1919 include module runners similar to those described previously (although they are not specifically depicted in FIGS. 19A, 19B, 20A and 20B). Such floor parts 1919 are coupled together to provide floor space over which the central and internal modules 2, 3 can extend and cover, once the floor parts 1919 (which may be formed as two doubly-hinged panels or a series of parallel doubly-hinged panels) are extended outwardly to lie flat. FIGS. 20A and 20B illustrate how the floor parts 1919 can hingedly fold and extend outwardly as part of the expansion process. FIGS. 21A and 21B illustrate the floor parts 1919 in the extended flat position and FIGS. 22A and 22B illustrate the internal and central modules 3, 2 having been extended away from the external module 4 and base unit 25 along runners provided by the floor parts to extend across and cover the extended floor panels 1919.

Figure 23A:
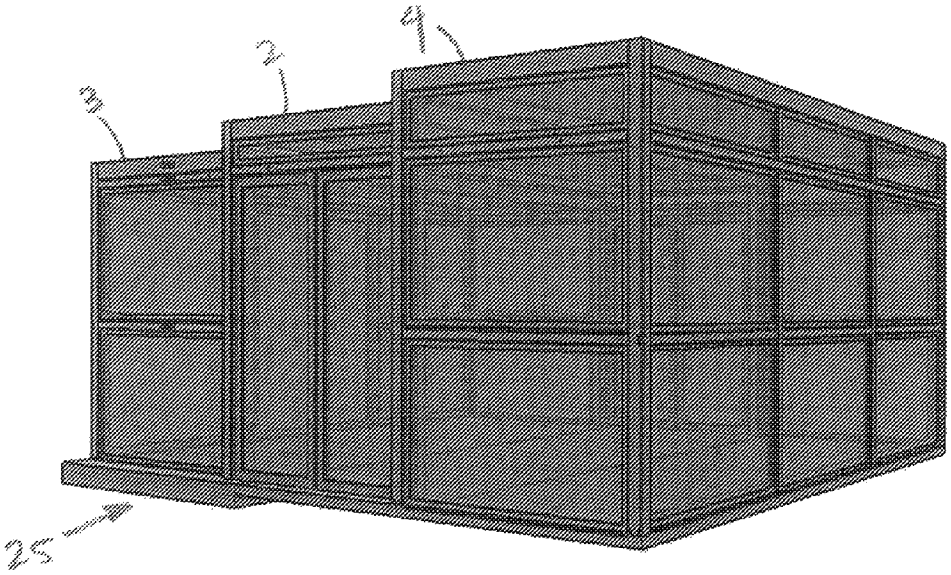
FIGS. 23A and 23B are perspective views of an expandable building structure according to further embodiments, which are similar to the embodiments shown in FIGS. 22A and 22B, but where the internal module forms part of the base unit, instead of the external module or the centre module.
Figure 23B:
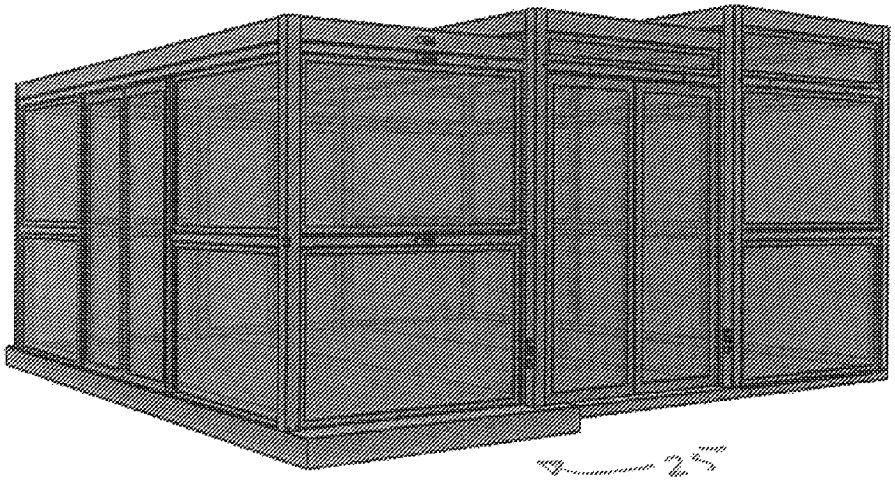
Figure 24A:
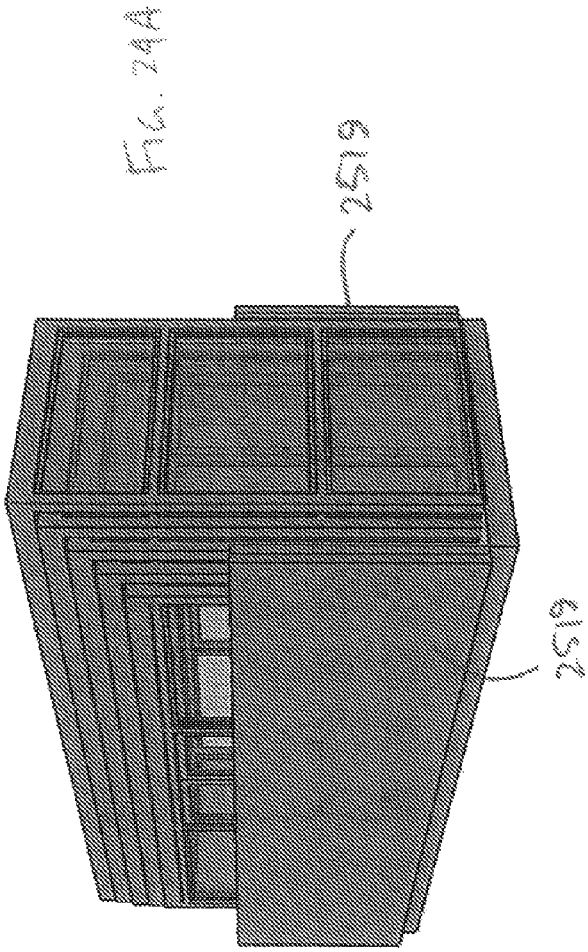
FIGS. 24A and 24B are perspective views of an expandable building structure according to still further embodiments that include five nested frame modules instead of three nested modules.
Figure 24B:
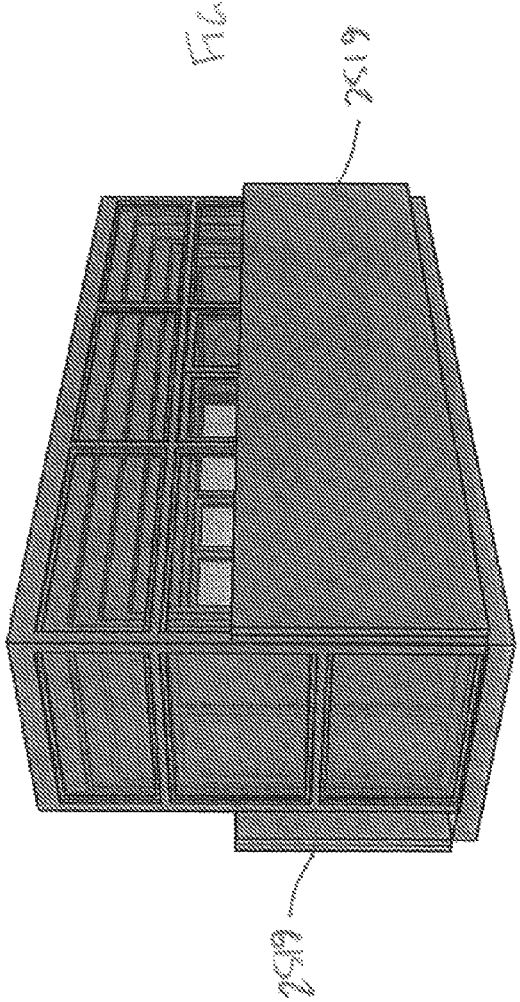

FIGS. 23A and 23B illustrate an expandable building structure 2300 according to further embodiments. Such further embodiments are similar to the embodiments described in FIGS. 1 to 22, except that in the embodiments shown in FIGS. 23A and 23B, the internal module 3 forms part of the base unit 25 and the central and external modules 2 and 4 move away from the internal module 3 into the expanded state once the floor parts have been extended outwardly and laid flat in a similar manner to that depicted in FIGS. 19 to 21. Thus, it can be seen that any one of the frame modules of the expandable building structures described can form part of the base unit 25 and effectively remain fixed, while the other frame modules expand away from the fixed frame module.

Depending on the particular frame module that forms part of the base unit 25, the floor parts may be coupled together and folded out together for deployment of the structure into the expanded position. For such embodiments, the floor parts of the frame modules not forming part of the base unit 25 are folded outwardly or otherwise laid out flat for the movable frame modules to extend thereover when adopting the expanded configuration. Similarly, when retraction into the compacted configuration is required, the movable frame modules are retracted to positions over the base unit 25, so that all of the frame modules nest neatly together as shown in the drawings. Then the floor parts can be raised, preferably by hinged folding, up against one or both sides of the compacted frame modules to lie flat against the exterior (or in some embodiments interior) of such modules in vertical orientations. It should be noted, however, that in some embodiments, the floor parts may be positioned to retract inside the volume of the internal frame module and to be laid down and retracted before expansion and contraction, respectively, of the frame modules. For embodiments that fold up the floor parts internally of the modules, the module runners 9 still remain external, when folded up against the frame modules.

Figure 30A:
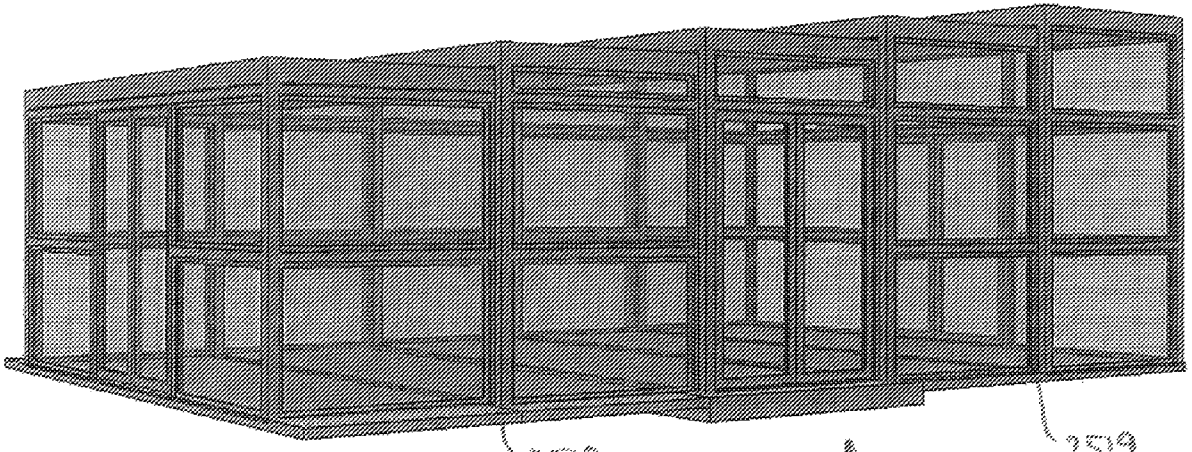
FIGS. 30A and 30B are perspective views of the expandable building structure of FIGS. 24A and 24B shown in a fully expanded, open configuration.
Figure 30B:
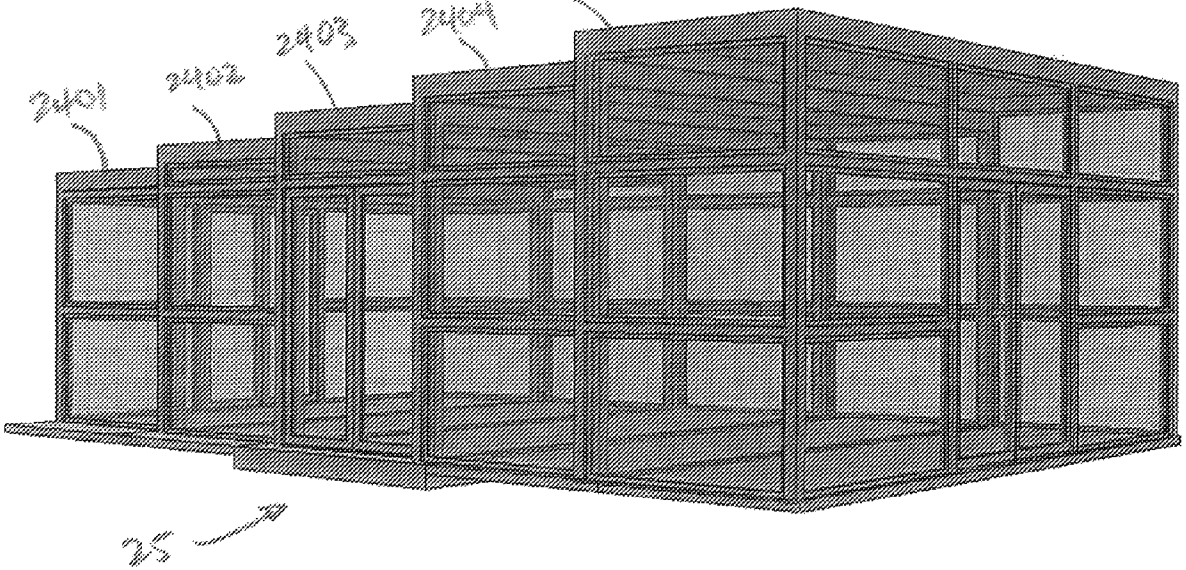

Referring now to FIGS. 24A to 30B, an expandable building structure 2400 according to further embodiments is shown and described in further detail. The expandable building structure 2400 of such embodiments has more than three frame modules and more than two moveable modules that can be deployed to adopt the open configuration. The expandable building structure embodiments 2400 shown in FIGS. 24A to 30B show an example of five nested frame modules that can be telescopically expanded to adopt the open configuration, as illustrated in FIGS. 30A and 30B. For this purpose, the expandable building structure 2400 has one of the frame elements fixedly coupled as part of the base unit 25, so that the other frame modules move away from that fixed frame module to adopt the open configuration. In the example illustrated, a central frame module 2403 forms part of the base unit 25.

In the example expandable building structure 2400 shown in FIGS. 24A to 30B, there is a central frame module 2403 within which is nested an intermediate internal frame module 2402 and outside of which nests an intermediate external frame 2404 module. Within the intermediate internal module 2042 nests an internal frame module 2401 in a similar manner as described in relation to other embodiments described herein. Outside the intermediate external frame module 2404 nests an external frame module 2405 in a similar manner to other embodiments described herein.

Figure 25A:
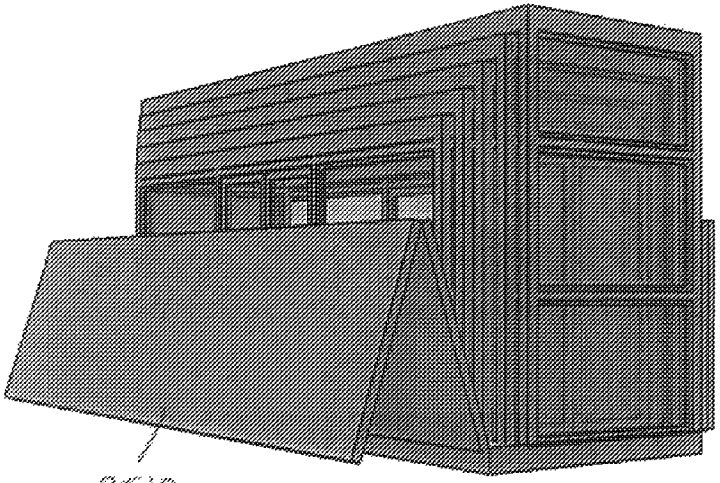
FIGS. 25A and 25B are perspective views of the structure of FIGS. 24A and 24B, showing floor parts of one side of the structure in a partial state of deployment.
Figure 25B:
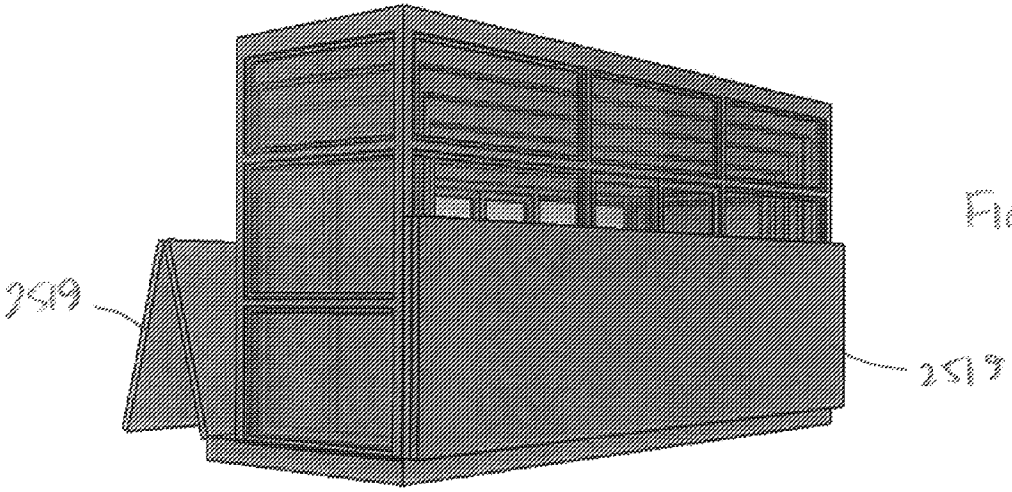
Figure 26A:
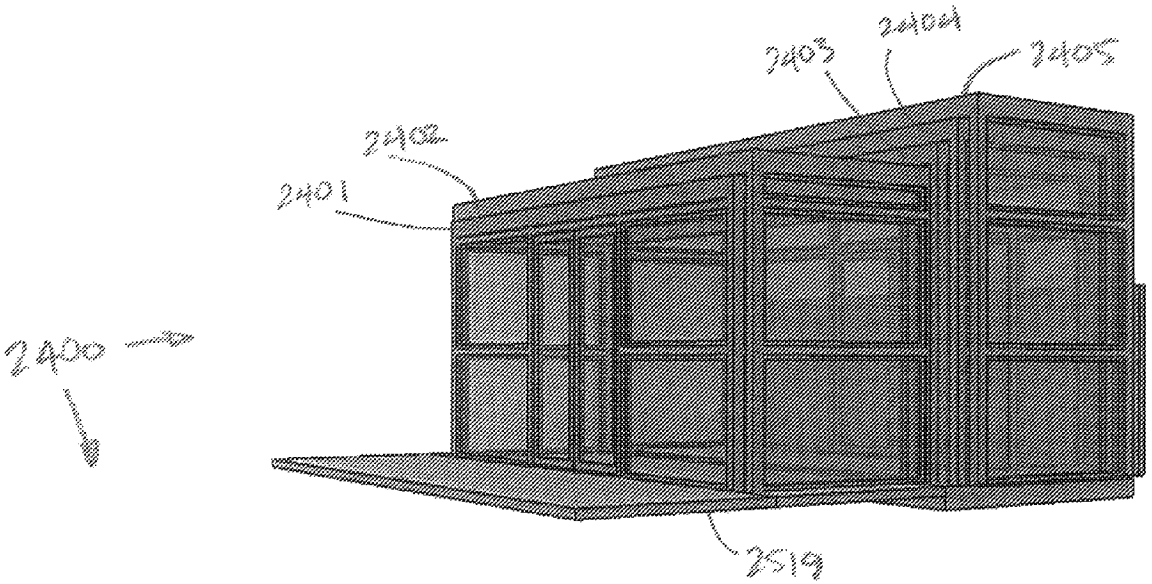
FIG. 26A and FIG. 26B are perspective views of the expandable building structure of FIGS. 24A and 24B showing partial extension of frame modules on one side of the structure over the deployed floor parts.
Figure 26B:
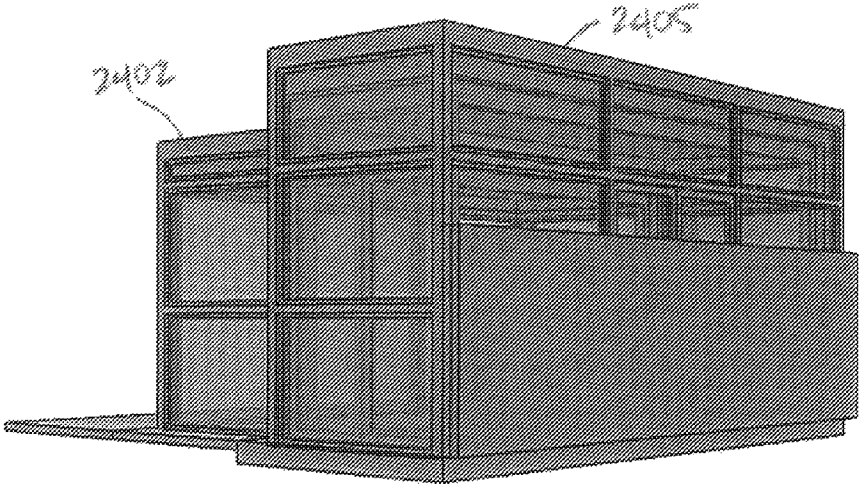
Figure 27A:
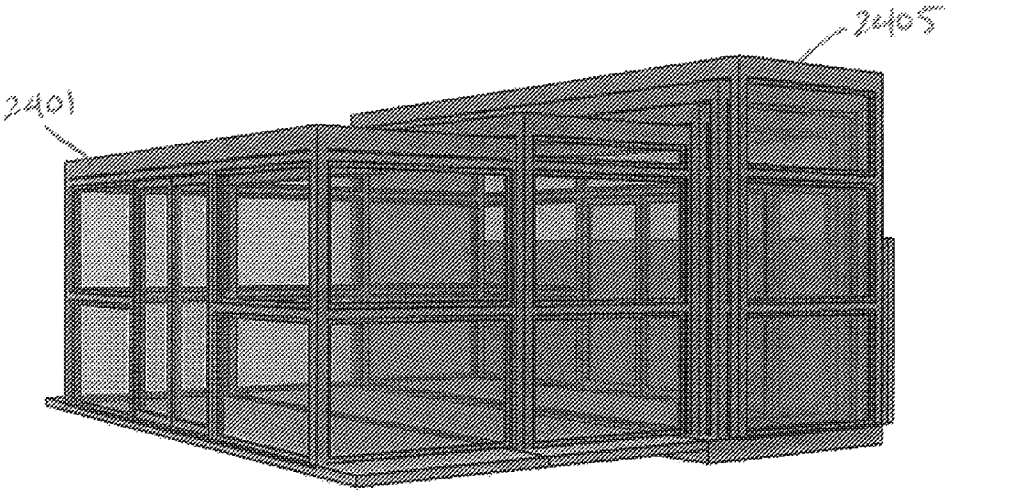
FIGS. 27A and 27B are perspective views of the expandable building structure of FIGS. 24A and 24B, showing the frame modules fully extended on one side of the structure.
Figure 27B:
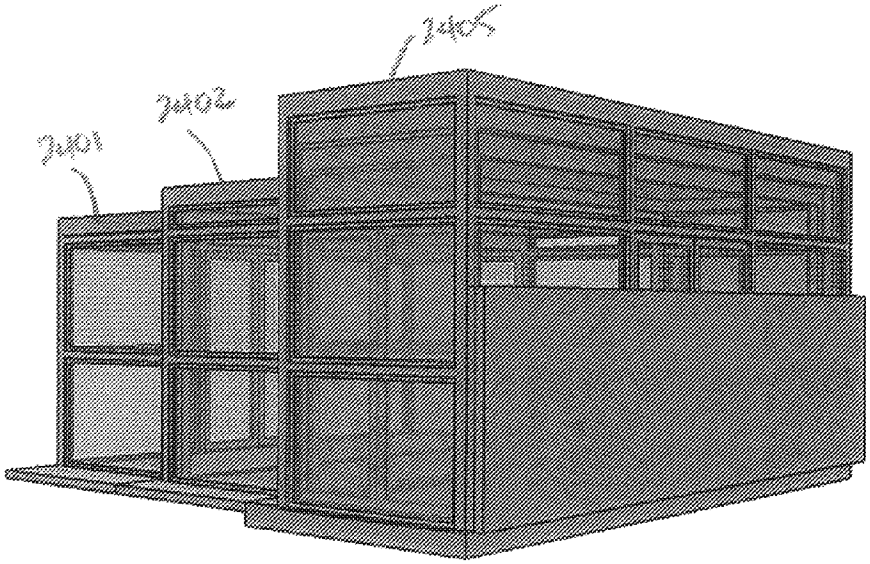
Figures 28A, 28B:
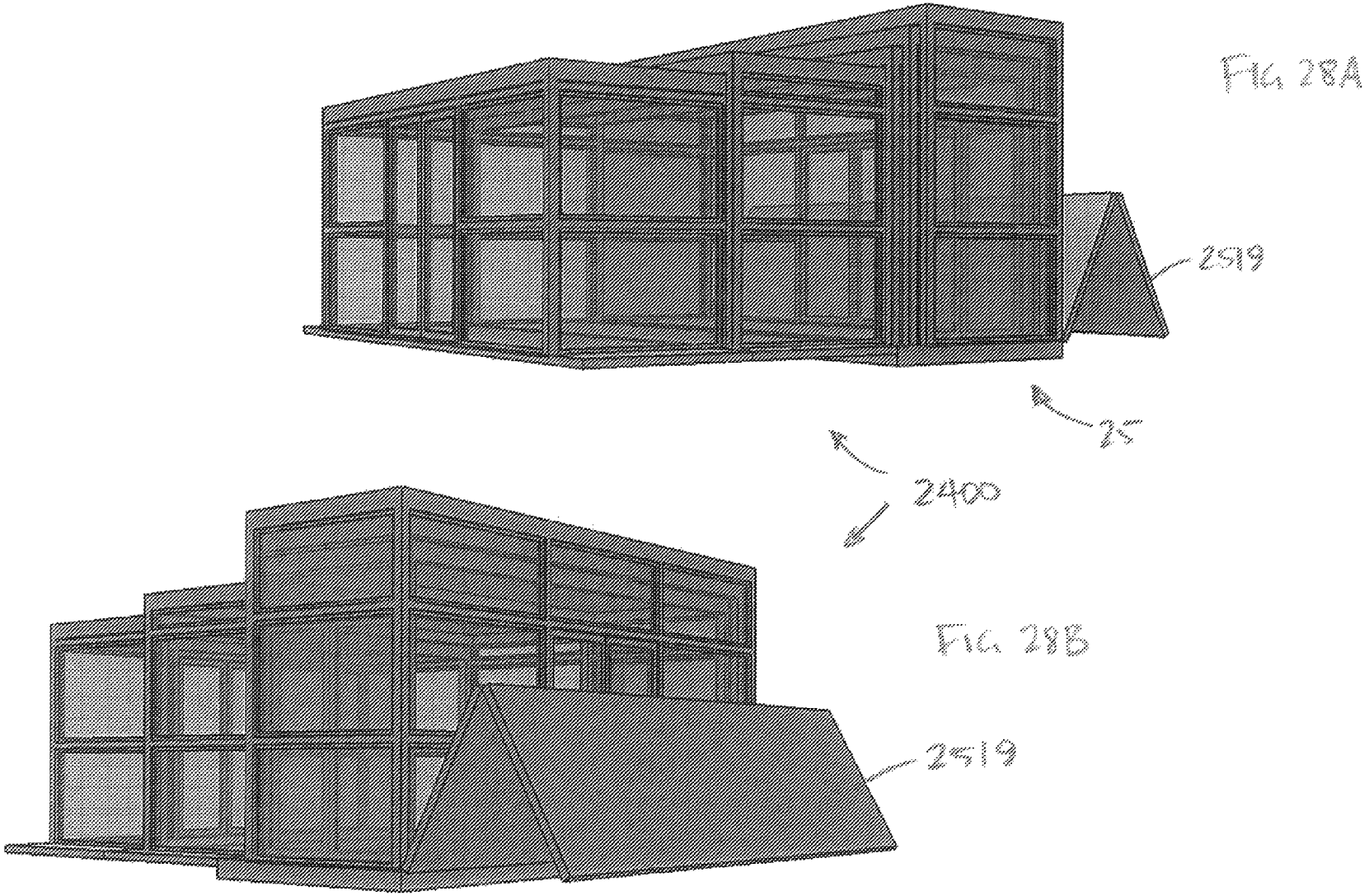
FIGS. 28A and 28B are perspective views of the expandable building structure of FIGS. 24A and 24B showing the floor parts on an opposite side of the structure in a state of partial deployment.
Figures 29A, 29B:
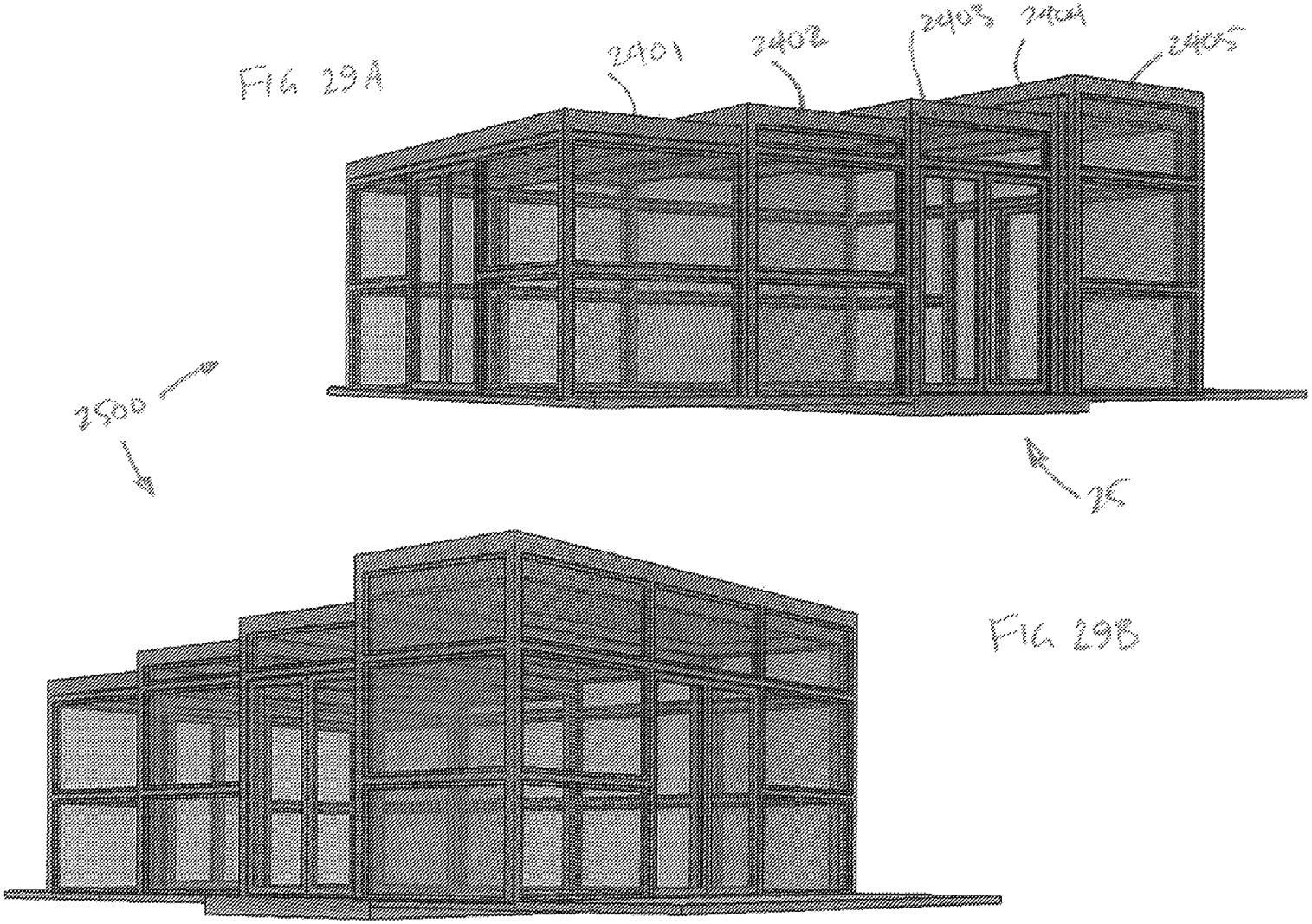
FIGS. 29A and 29B are perspective views of the expandable building structure of FIGS. 24A and 24B showing frame modules on an opposite side of the structure in a state of partial extension over the deployed floor parts.

FIGS. 25A and 25B illustrate floor parts 2519 on one side of the expandable building structure 2400 in a state of partial extension and deployment. FIGS. 26A and 26B show the floor parts 2519 laid out flat, with the intermediate internal module 2402 and internal frame module 2401 extended out over a near part of the extended floor panels. FIGS. 27A and 27B show the internal frame module 2401 and intermediate internal frame module 2402 in a fully extended state on one side on the base unit 25. FIGS. 28A, 28B, 29A, 29B, 30A and 30B show a similar step-wise progression of expansion on an opposite side of the base unit 25, whereby the floor parts 2519 are extended to lie flat and the external frame module 2405 and the intermediate external frame module 2404 are moved away from the central frame module 2403 and base unit 25 toward a fully deployed and extended open position. As with other embodiments described herein, each of the frame modules has side braces 15 at a same height in order to provide for modularised window, door and wall inserts along at least the side wall. As with other embodiments described herein, the remainder of the upper part of the frame module may have permanently fixed windows or opaque wall inserts therein.

The expandable building structure embodiments 2400 shown in FIGS. 24A to 30B may employ a base unit position other than at the central frame module and may be serially concatenated in a similar manner to the embodiments 1700 shown in FIGS. 17 and 18. Similarly, such expandable building structure embodiments 2400 can be fixed in the closed or open positions with similar fixation means to that described in FIGS. 10A, 10B, 11A and 11B and similar drainage structures may be provided to that shown in FIGS. 15A to 15G.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

LEGEND

1. Expandable building structure
2. Central module
3. Internal module
4. External module
5. Roof portion
6. Floor portion
7. Side portion
8. Module runner
9. Runner arms
10. Runner track
11. Runner hinge
12. Lower brace
13. Internal central track
14. External central track
15. Side brace
16. End brace
17. Floor bearers
18. Runner brace
19. Floor inserts
20. Stop means
21. End portion
22. Floor insert mount
23. Floor insert hinge
25. Base unit
26. Base unit floor frame
50. Position fixation apertures (closed position)
51. Tapered pin
52. Position fixation apertures (open position)
60. Vertical corner post
61. Horizontal cross-bar
62. Fastener
64. Upper longitudinal cross-beam
65. Lower positioning cross-bar for securing stanchion
66. Top lateral cross-bar
68. Vertical stanchion
71. Frame structure/elements
72. Fastener
75. Window insert
76. Door insert
78. Angled plate
79. Sealing strip
81. Drainage conduit
82. Drainage aperture
1700. Expanded building structure
1707. Upper connecting plate
1708. Lower connecting plate
1709. Bolt
1711. Sealing strip
1900. Expandable building structure
1919. Floor parts
2300. Expandable building structure
2400. Expandable building structure
2401. Internal module
2402. Intermediate internal module
2403. Central module
2404. Intermediate external module
2405. External module
2519. Floor parts

The invention claimed is:

1. A transportable expandable building structure adjustable between a contracted state to enable transportation of the building structure, and an expanded state to provide the building structure for human occupancy, the expandable building structure comprising:

at least first, second and third frame modules arranged to nest with each other in the contracted state and to telescopically expand into the expanded state, wherein one of the first, second and third frame modules is a base unit frame module that forms part of a base unit comprising a fixed floor arranged to support the building structure in the contracted state, and the other frame modules are expander modules comprising wheels or rollers and arranged to be movable away from the base unit to adopt the expanded state; and tracks associated with each of the expander modules, each track comprising:

a fixed portion fixed to an adjacent one of the frame modules to the associated expander module to support the associated expander module in the contracted state; and an extension portion hingedly coupled to the adjacent frame module to support the associated expander module in the expanded state, wherein the extension portion is rotated up alongside the adjacent frame module in the contracted state and is rotated out so as to extend away from the adjacent frame module in the expanded state, such that the fixed portion and extension portion are aligned and together define a channel configured to receive the wheels or rollers of the associated expander module and to allow movement of the expander module along the track between the contracted state and the expanded state, and wherein each of the frame modules is different in size from the adjacent one of the frame modules and comprises a floor portion, a roof portion and opposed side portions.

2. The structure of claim 1, wherein each side portion defines a same-sized modular insert region to receive modular door, window or wall inserts.

3. The structure of claim 1, wherein the side portions of the expander modules include a lower brace incorporating the wheels or rollers.

4. The structure of claim 1, wherein the at least first, second and third frame modules comprise a drainage structure to drain water from respective said roof portions.

5. The structure of claim 1, wherein in the expanded state, floor mounts for supporting the floor portions of the expander modules are folded down from the base unit to receive the floor portions, such that the floor portions of each expander module are level with the fixed floor of the base unit.

6. The structure of claim 5, wherein the floor portions for the expander modules each comprise one or more floor inserts, each floor insert configured to allow handling by a single operator.

7. The structure of claim 1, further comprising fixation means to fix the first, second and third frame modules in the contracted state or in the expanded state.

8. The structure of claim 7, wherein the fixation means includes a series of apertures located in the first, second and third frame modules so that pins received in aligned ones of the apertures substantially prevent movement of the first, second and third frame modules between the contracted state and the expanded state.

9. The structure of claim 1, further comprising a fourth frame module arranged to nest with the first, second and third frame modules.

10. The structure of claim 9, further comprising a fifth frame module arranged to nest with the first, second, third and fourth frame modules.

11. The structure of claim 1, wherein the first frame module is an internal frame module, the second frame module is a central frame module and the third frame module is an external frame module.

12. The structure of claim 11, further comprising a module runner connected to the base unit to guide expansion and contraction of frame modules other than the base unit frame module, wherein the module runner is hinged to said base unit and movable between a closed configuration folded against open end portions of said central module and an open configuration folded down to align with said floor portion of said central module, and wherein the module runner comprises two parallel runner arms hinged at an end proximate to said central module, with each runner arm including the extension portions of the tracks.

13. The structure of claim 11, wherein the side portions of each of the central, internal and external modules comprise side braces positioned to present areas of a same dimension in the side portions of the central, internal and external modules.

14. The structure of claim 11, wherein the end portions of the internal and external modules comprise end braces positioned to present areas of a same dimension in the internal and external modules.

15. The structure of claim 11, wherein the side portions of each of the central, internal and external modules comprise connection sections configured to allow a lateral cross-bar to be connected to extend across a respective said side portion.

16. The structure of claim 15, further comprising the lateral cross-bar connected to the connection sections to extend across at least one of the side portions, and further comprising at least one sub-frame to be supported by the respective at least one side portion and the lateral cross-bar, the at least one sub-frame being configured to receive a modular window or wall insert.

17. The structure of claim 11, wherein end portions of each of the internal and external modules comprise connection sections configured to allow at least one vertical stanchion to be connected to extend across a respective said end portion.

18. The structure of claim 17, further comprising the at least one vertical stanchion connected to end portion connection sections to extend across at least one of the end portions and further comprising at least one sub-frame to be supported by the respective at least one end portion and at least one vertical stanchion, the at least one sub-frame being configured to receive a modular window, wall or door frame insert.

19. An assembly of transportable expandable building structures, comprising:

a plurality of the transportable expandable building structures of claim 1; and wherein first and second structures of the plurality are positioned adjacent to each other, wherein the first structure and the second structure are in the expanded state and wherein internal space of the first structure communicates with another internal space of the second structure.

20. The assembly of claim 19, wherein the base units of the first and second structures are arranged in parallel and in lateral alignment.

21. The assembly of claim 19, wherein the internal space of the first structure and the another internal space of the second structure defines a substantially open interior space.

22. The assembly of claim 19, further comprising a sealing structure to seal a common space between adjacently positioned frame modules of the first and second structures against water ingress.

23. The assembly of claim 19, further comprising a third structure of the plurality, wherein the third structure is in the expanded state and is positioned adjacent the first structure, wherein the first structure and the third structure are arranged so that the internal space of the first structure communicates with internal space of the third structure.

* * * * *